US011633645B2

(12) United States Patent
Kordecki

(10) Patent No.: US 11,633,645 B2
(45) Date of Patent: Apr. 25, 2023

(54) EXERCISE APPARATUS FOR PERFORMING A GLUTEAL BRIDGE MOVEMENT

(71) Applicant: Kormel LLC, Vernon Hills, IL (US)

(72) Inventor: Michael Kordecki, Vernon Hills, IL (US)

(73) Assignee: Kormel LLC, Vernon Hills, IL (US)

( * ) Notice: Subject to any disclaimer, the term of this patent is extended or adjusted under 35 U.S.C. 154(b) by 32 days.

(21) Appl. No.: 17/486,266

(22) Filed: Sep. 27, 2021

(65) Prior Publication Data

US 2022/0080257 A1 Mar. 17, 2022

Related U.S. Application Data

(63) Continuation of application No. 16/841,396, filed on Apr. 6, 2020, now Pat. No. 11,130,018, which is a
(Continued)

(51) Int. Cl.
*A63B 23/04* (2006.01)
*A63B 21/00* (2006.01)
(Continued)

(52) U.S. Cl.
CPC .... *A63B 23/0482* (2013.01); *A63B 21/00047* (2013.01); *A63B 21/0421* (2013.01);
(Continued)

(58) Field of Classification Search
CPC ..... A63B 21/4021; A63B 21/0552; A63B 21/4009; A63B 21/4031; A63B 21/4047;
(Continued)

(56) References Cited

U.S. PATENT DOCUMENTS 799,803 A 9/1905 Rathbone
3,130,968 A 4/1964 De Feen
(Continued)

FOREIGN PATENT DOCUMENTS

CN 203525211 10/2013
WO 2016035029 3/2016
WO 2016154565 9/2016

OTHER PUBLICATIONS

PCT Search Report and Written Opinion for International Application No. PCT/US2018/032389, dated Sep. 5, 2018, 7 pages.
(Continued)

*Primary Examiner* — Megan Anderson
(74) *Attorney, Agent, or Firm* — Barnes & Thornburg LLP

(57) ABSTRACT

The present disclosure provides an exercise apparatus designed to allow a user to perform a gluteal bridge, typically with resistance, to improve the strength of the user's posterior hip and gluteal muscles. The exercise apparatus is configurable for use in different environments—in a gym, fitness center or training facility, a spa or studio, or a home gym. The exercise apparatus includes a frame assembly, a bench assembly, and a resistance assembly. The bench assembly is pivotally connected to the frame assembly to provide an elevated pivot point about which the bench assembly pivots when the user performs the gluteal bridge movement. The resistance assembly is operably connected to the bench assembly and provides a resistance force that the user overcomes in order to pivotally move the bench through the gluteal bridge movement. The resistance assembly can include a cable, pulley and weight stack, or an elastically deformable band.

25 Claims, 32 Drawing Sheets

Related U.S. Application Data continuation of application No. 16/277,356, filed on Feb. 15, 2019, now Pat. No. 10,610,729, which is a continuation of application No. 15/977,715, filed on May 11, 2018, now Pat. No. 10,226,665.

(60) Provisional application No. 62/563,456, filed on Sep. 26, 2017, provisional application No. 62/505,542, filed on May 12, 2017.

(51) Int. Cl.

| | |
|---|---|
| ***A63B 23/02*** | (2006.01) |
| ***A63B 21/062*** | (2006.01) |
| ***A63B 21/06*** | (2006.01) |
| ***A63B 21/04*** | (2006.01) |
| ***A63B 21/055*** | (2006.01) |
| *A63B 21/008* | (2006.01) |
| *A63B 21/005* | (2006.01) |

(52) U.S. Cl.

CPC ..... *A63B 21/0552* (2013.01); *A63B 21/0628* (2015.10); *A63B 21/4009* (2015.10); *A63B 21/4029* (2015.10); *A63B 21/4031* (2015.10); *A63B 21/4045* (2015.10); *A63B 21/4047* (2015.10); *A63B 23/0216* (2013.01); *A63B 23/0222* (2013.01); *A63B 21/005* (2013.01); *A63B 21/008* (2013.01); *A63B 21/06* (2013.01); *A63B 21/062* (2013.01); *A63B 21/0624* (2015.10); *A63B 2023/0411* (2013.01); *A63B 2210/50* (2013.01)

(58) Field of Classification Search

CPC ..... A63B 21/00047; A63B 21/4029; A63B 21/4045; A63B 23/0482; A63B 23/0222; A63B 23/0216; A63B 2023/0411

See application file for complete search history.

(56) References Cited

U.S. PATENT DOCUMENTS

| | | | |
|---|---|---|---|
| 3,451,271 | A | 6/1969 | Knoblauch |
| 3,567,218 | A | 3/1971 | Johnson |
| 3,682,475 | A | 8/1972 | Walker |
| 3,948,513 | A | 4/1976 | Pfotenhauer |
| 4,249,726 | A | 2/1981 | Faust |
| 4,398,713 | A | 8/1983 | Ellis |
| 4,531,727 | A | 7/1985 | Pitre |
| 4,582,319 | A | 4/1986 | Luna |
| 4,609,193 | A | 9/1986 | Paris et al. |
| 4,627,423 | A | 12/1986 | Kampner |
| 4,753,438 | A | 6/1988 | Paris et al. |
| 4,757,998 | A | 7/1988 | Landin |
| 4,775,150 | A | 10/1988 | Graham |
| 4,848,742 | A | 7/1989 | Lindley et al. |
| 4,863,163 | A | 9/1989 | Wehrell |
| 4,902,003 | A | 2/1990 | Buoni |
| 4,915,378 | A | 4/1990 | Abrahamian et al. |
| 4,968,028 | A | 11/1990 | Wehrell |
| 4,979,732 | A | 12/1990 | Rushatz et al. |
| 5,042,800 | A | 8/1991 | Walter |
| 5,060,937 | A | 10/1991 | Rushatz et al. |
| 5,141,480 | A | 8/1992 | Lennox et al. |
| 5,147,259 | A | 9/1992 | Hutchins |
| 5,147,267 | A | 9/1992 | Kunewalder |
| 5,160,306 | A | 11/1992 | Lui |
| 5,183,452 | A | 2/1993 | Bacon et al. |
| 5,215,511 | A | 6/1993 | Cheng |
| 5,221,246 | A | 6/1993 | Torii |
| 5,244,446 | A | 9/1993 | Engel et al. |
| 5,281,193 | A | 1/1994 | Colbo |
| 5,299,998 | A | 4/1994 | Hutchins |
| 5,306,220 | A | 4/1994 | Kearney |
| 5,330,408 | A | 7/1994 | Westmoreland |
| 5,336,152 | A | 8/1994 | Winslow et al. |
| 5,346,448 | A | 9/1994 | Sollo |
| 5,350,346 | A | 9/1994 | Martinez |
| 5,387,171 | A | 2/1995 | Casey et al. |
| 5,433,220 | A | 7/1995 | Kostich |
| 5,433,685 | A | 7/1995 | Winslow et al. |
| 5,441,473 | A | 8/1995 | Safani et al. |
| 5,460,587 | A | 10/1995 | Hutchins |
| 5,492,520 | A | 2/1996 | Brown |
| 5,551,934 | A | 9/1996 | Binette |
| 5,556,363 | A | 9/1996 | Hutchins |
| 5,577,987 | A | 11/1996 | Brown |
| 5,580,340 | A | 12/1996 | Yu |
| 5,584,786 | A | 12/1996 | Almeda |
| 5,599,261 | A | 2/1997 | Easley et al. |
| 5,623,949 | A | 4/1997 | Kostich |
| 5,681,250 | A | 10/1997 | Hoover et al. |
| 5,722,917 | A | 3/1998 | Olschansky et al. |
| 5,733,232 | A | 3/1998 | Hsu |
| 5,772,612 | A | 6/1998 | Ilan |
| 5,795,276 | A | 8/1998 | Almeda |
| 5,888,181 | A | 3/1999 | Yeh |
| 5,897,470 | A | 4/1999 | Chen |
| 5,899,836 | A | 5/1999 | Chen |
| 5,913,759 | A | 6/1999 | Bostrom |
| 5,931,768 | A | 8/1999 | Amesquita |
| 5,935,050 | A | 8/1999 | Shahan |
| 5,954,056 | A | 9/1999 | Eckman |
| 5,971,901 | A | 10/1999 | Shaw |
| 5,971,902 | A | 10/1999 | Robertson et al. |
| 6,152,866 | A | 11/2000 | Kuo |
| 6,168,557 | B1 | 1/2001 | Liao |
| 6,190,345 | B1 | 2/2001 | Henderson |
| 6,206,809 | B1 | 3/2001 | Habing et al. |
| 6,220,994 | B1 | 4/2001 | Rich |
| 6,258,050 | B1 | 7/2001 | Henderson |
| 6,280,367 | B1 | 8/2001 | Arsenault |
| 6,299,569 | B1 | 10/2001 | Rich |
| 6,319,180 | B1 | 11/2001 | Kallassy |
| 6,398,699 | B1 | 6/2002 | Yang |
| 6,402,667 | B1 | 6/2002 | Dahn |
| 6,468,188 | B1 | 10/2002 | Koenig |
| 6,475,127 | B1 | 11/2002 | Koenig |
| 6,533,710 | B2 | 3/2003 | Lin et al. |
| 6,554,751 | B1 | 4/2003 | Dannelly |
| 6,605,024 | B2 | 8/2003 | Stearns |
| 6,623,270 | B1 | 9/2003 | Meldeau |
| 6,663,546 | B2 | 12/2003 | Kallassy |
| 6,676,577 | B2 | 1/2004 | Stearns |
| 6,685,601 | B1 | 2/2004 | Knapp |
| 6,692,417 | B2 | 2/2004 | Burrell |
| 6,692,418 | B2 | 2/2004 | Shahan |
| 6,716,144 | B1 | 4/2004 | Shifferaw |
| 6,752,745 | B1 | 6/2004 | Davis |
| 6,786,855 | B2 | 9/2004 | Prichard |
| 6,793,610 | B2 | 9/2004 | Deola |
| 6,827,676 | B2 | 12/2004 | Kuo |
| 6,872,170 | B2 | 3/2005 | Kuo |
| 6,887,190 | B1 | 5/2005 | Azari |
| 6,916,278 | B2 | 7/2005 | Webber |
| 6,926,647 | B1 | 8/2005 | Huang et al. |
| 6,955,635 | B2 | 10/2005 | Chelekis |
| 6,966,872 | B2 | 11/2005 | Eschenbach |
| 6,981,932 | B1 | 1/2006 | Huang et al. |
| 7,033,307 | B2 | 4/2006 | Van Straaten |
| 7,044,898 | B2 | 5/2006 | Kuo et al. |
| 7,044,899 | B2 | 5/2006 | Kuo |
| 7,052,444 | B2 | 5/2006 | Webber |
| 7,074,164 | B2 | 7/2006 | Moring, Jr. et al. |
| 7,083,558 | B2 | 8/2006 | Williams, Sr. |
| 7,087,005 | B2 | 8/2006 | Rouillard |
| 7,104,933 | B1 | 9/2006 | Liao |
| 7,115,081 | B2 | 10/2006 | Stearns |
| 7,125,371 | B2 | 10/2006 | Henderson |
| 7,128,701 | B1 | 10/2006 | Ketcham |
| 7,137,933 | B2 | 11/2006 | Shifferaw |
| 7,137,934 | B2 | 11/2006 | Paramater |
| 7,357,759 | B2 | 4/2008 | Bonnell |

(56) References Cited

U.S. PATENT DOCUMENTS

| | | | | |
|---|---|---|---|---|
| 7,367,928 | B2 | 5/2008 | Storch | |
| 7,458,922 | B2 | 12/2008 | Pisciottano | |
| 7,476,188 | B2 | 1/2009 | Perez, Jr. | |
| 7,481,750 | B2 | 1/2009 | Fishel | |
| 7,488,277 | B1 | 2/2009 | Knapp | |
| 7,488,281 | B2 | 2/2009 | Weir et al. | |
| 7,637,851 | B1 | 12/2009 | Lormil | |
| 7,717,837 | B2 | 5/2010 | Florczak | |
| 7,736,286 | B2 | 6/2010 | Panaiotov | |
| 7,775,951 | B2 | 8/2010 | Chu | |
| 7,806,812 | B2 | 10/2010 | Humble et al. | |
| 7,871,359 | B2 | 1/2011 | Humble et al. | |
| 7,938,760 | B1 | 5/2011 | Webber et al. | |
| 7,967,738 | B2 | 6/2011 | Dauterive | |
| 7,985,168 | B2 | 7/2011 | Reyes | |
| 8,052,586 | B2 | 11/2011 | Hahn | |
| 8,062,189 | B1 | 11/2011 | Moring, Jr. et al. | |
| 8,083,654 | B1 | 12/2011 | MacDonald et al. | |
| 8,123,663 | B2 | 2/2012 | Fey et al. | |
| 8,172,736 | B2 | 5/2012 | Contreras | |
| 8,177,693 | B2 | 5/2012 | Webber et al. | |
| 8,216,116 | B2 | 7/2012 | Canali | |
| 8,267,843 | B2 | 9/2012 | Dellino | |
| 8,328,700 | B2 | 12/2012 | Humble et al. | |
| 8,419,594 | B2 | 4/2013 | Motoyashiki | |
| 8,465,399 | B2 | 6/2013 | Tommy, Jr. et al. | |
| 8,465,403 | B2 | 6/2013 | McCall, Jr. | |
| 8,747,287 | B2 | 6/2014 | Li | |
| 8,784,286 | B2 | 7/2014 | Reyes | |
| 8,808,151 | B1 | 8/2014 | Whaley | |
| 8,939,872 | B2 | 1/2015 | Sprague | |
| 8,968,164 | B2 | 3/2015 | Giannelli | |
| 8,986,179 | B2 | 3/2015 | Cares | |
| 9,050,492 | B2 | 6/2015 | Shifferaw | |
| 9,101,792 | B2 | 8/2015 | Ho et al. | |
| 9,126,073 | B2 | 9/2015 | Ho et al. | |
| 9,132,313 | B2 | 9/2015 | Jones et al. | |
| 9,168,416 | B2 | 10/2015 | Ho et al. | |
| 9,211,434 | B2 | 12/2015 | Giannelli et al. | |
| 9,320,937 | B2 | 4/2016 | Thompson | |
| 9,339,688 | B1 | 5/2016 | Campbell | |
| 9,358,419 | B1 | 6/2016 | Smith | |
| 9,446,285 | B1 | 9/2016 | Drath et al. | |
| 9,468,800 | B2 | 10/2016 | Guerrero | |
| 9,474,923 | B2 | 10/2016 | Davenport | |
| 9,630,055 | B2 | 4/2017 | Runyan | |
| 9,643,047 | B1 | 5/2017 | Chen | |
| 9,656,116 | B2 | 5/2017 | Giannelli et al. | |
| 9,662,531 | B2 | 5/2017 | Giannelli et al. | |
| 9,669,255 | B2 | 6/2017 | Henniger | |
| 9,737,750 | B2 | 8/2017 | Garcia Lopez | |
| 9,757,608 | B2 | 9/2017 | Davenport | |
| 9,782,622 | B2 | 10/2017 | Hornback | |
| 10,226,665 | B2 | 3/2019 | Kordecki | |
| 10,500,439 | B1 * | 12/2019 | Holman | A63B 21/0628 |
| 10,610,729 | B2 | 4/2020 | Kordecki | |
| 11,130,018 | B2 | 9/2021 | Kordecki | |
| 2002/0022556 | A1 | 2/2002 | Eriksson et al. | |
| 2002/0173412 | A1 | 11/2002 | Stearns | |
| 2002/0193216 | A1 | 12/2002 | Wu | |
| 2003/0050155 | A1 | 3/2003 | Lat | |
| 2003/0060347 | A1 | 3/2003 | Tang | |
| 2003/0211920 | A1 | 11/2003 | Mandel | |
| 2004/0002413 | A1 | 1/2004 | Wimber | |
| 2004/0005971 | A1 | 1/2004 | Kuo | |
| 2004/0053757 | A1 | 3/2004 | Chung | |
| 2004/0229734 | A1 | 11/2004 | Stearns | |
| 2005/0101463 | A1 | 5/2005 | Chen | |
| 2005/0181916 | A1 | 8/2005 | Frost et al. | |
| 2005/0187085 | A1 | 8/2005 | Webb | |
| 2005/0250629 | A1 | 11/2005 | Webb | |
| 2005/0250630 | A1 | 11/2005 | Webb | |
| 2006/0100075 | A1 | 5/2006 | Harsh | |
| 2006/0135329 | A1 | 6/2006 | Owen | |
| 2007/0203003 | A1 | 8/2007 | Brawner | |
| 2008/0004165 | A1 | 1/2008 | Brawner | |
| 2008/0039295 | A1 | 2/2008 | Steinmetz | |
| 2008/0176725 | A1 | 7/2008 | Mehendale | |
| 2008/0228115 | A1 | 9/2008 | Racoosin | |
| 2008/0254951 | A1 | 10/2008 | Chu | |
| 2008/0254956 | A1 | 10/2008 | Purvis | |
| 2008/0318741 | A1 | 12/2008 | Sencil et al. | |
| 2009/0042703 | A1 | 2/2009 | Pisciottano | |
| 2009/0098988 | A1 | 4/2009 | Kennedy | |
| 2009/0143203 | A1 | 6/2009 | Knapp | |
| 2009/0176633 | A1 | 7/2009 | Dlugopolskiy | |
| 2009/0264265 | A1 | 10/2009 | Contreras | |
| 2009/0291807 | A1 | 11/2009 | Moring, Jr. et al. | |
| 2010/0311554 | A1 | 12/2010 | Chen | |
| 2011/0183826 | A1 | 7/2011 | Summers | |
| 2011/0256994 | A1 | 10/2011 | Dauterive | |
| 2011/0263389 | A1 | 10/2011 | Burgassi et al. | |
| 2011/0287905 | A1 | 11/2011 | Reyes | |
| 2012/0077651 | A1 | 3/2012 | Wallach | |
| 2012/0089183 | A1 | 4/2012 | Gostine et al. | |
| 2012/0178598 | A1 | 7/2012 | Fey et al. | |
| 2012/0202654 | A1 | 8/2012 | Contreras | |
| 2013/0005545 | A1 | 1/2013 | Wang | |
| 2013/0023390 | A1 | 1/2013 | Ree | |
| 2013/0059703 | A1 | 3/2013 | Calantoni | |
| 2013/0095987 | A1 | 4/2013 | Fey et al. | |
| 2014/0113780 | A1 | 4/2014 | Emmert | |
| 2014/0128231 | A1 | 5/2014 | Menaker | |
| 2015/0011370 | A1 | 1/2015 | Henniger | |
| 2015/0305954 | A1 | 10/2015 | Kuenzler | |
| 2015/0367168 | A1 | 12/2015 | Henniger et al. | |
| 2016/0114204 | A1 | 4/2016 | Swanson | |
| 2016/0184629 | A1 | 6/2016 | Hornback | |
| 2017/0001067 | A1 | 1/2017 | Drath et al. | |
| 2017/0056708 | A1 | 3/2017 | Kelly | |
| 2017/0144014 | A1 | 5/2017 | Porteros De Luz | |
| 2017/0239518 | A1 | 8/2017 | Porteros De Luz | |
| 2017/0304677 | A1 * | 10/2017 | Clinton | A63B 21/4047 |
| 2018/0001131 | A1 * | 1/2018 | Nevarez, Jr. | A63B 21/068 |
| 2018/0008857 | A1 | 1/2018 | Barber | |
| 2019/0111302 | A1 | 4/2019 | Ballestero | |
| 2019/0374814 | A1 | 12/2019 | KashKash et al. | |
| 2020/0338391 | A1 | 10/2020 | Hall et al. | |

OTHER PUBLICATIONS https://theglutebuilder.com/; The Glute Builder; Website; Dated Mar. 11, 2016.

https://www.t-nation.com/training/the-cure-for-weak-glutes; Website; Dated Apr. 19, 2016.

https://bootybuilder.com/en/; Website and Assembly Instructions; Dated Sep. 14, 2015.

http://www.tennisfitnesslove.com/2015/08/get-more-power-with-strong-glutes- -/; Website; Dated Aug. 6, 2015.

https://www.youtube.com/watch?v=geKfXHZY3O8; YouTube Video; Dated Sep. 17, 2014.

https://www.youtube.com/watch?v=GaRLKAWYNew; YouTube Video dated Nov. 30, 2015.

https://www.instagram.com/p/BH21EVVBEaS/?hl=en; Instagram Video dated July 147, 2016.

* cited by examiner

EXERCISE APPARATUS FOR PERFORMING A GLUTEAL BRIDGE MOVEMENT

PRIORITY CLAIM

This application claims priority from U.S. patent application Ser. No. 16/841,396, filed Apr. 6, 2020, which is a continuation of U.S. Pat. No. 10,610,729, issued Apr. 7, 2020, which is a continuation of U.S. Pat. No. 10,226,665, issued Mar. 12, 2019, which claims priority from U.S. Provisional Patent Application No. 62/563,456, filed Sep. 26, 2017 and U.S. Provisional Patent Application No. 62/505,542, filed May 12, 2017, all of which are incorporated herein by reference and made a part hereof.

TECHNICAL FIELD

This disclosure relates to an exercise apparatus for performing a gluteal bridge movement. In particular, the exercise apparatus is configurable to allow a person to properly perform a resisted gluteal bridge on a repeated basis and where the resistance increases the amount of work to be performed by the person during the exercise.

BACKGROUND

Muscles of the human posterior hip, or gluteal muscles, are critical for the task of locomotion. Healthy and/or well-developed gluteal muscles are a key factor in maintaining the strength and health of a person's lower back, hips and knees. Conversely, unhealthy and/or under-developed gluteal muscles have been identified as a significant cause of a number of conditions, including patellar alignment problems, iliotibial (IT) band pathology, and mechanical lower back pain.

An exercise technique referred to as a "gluteal bridge," which is also commonly referred to as a "glute bridge" or "hip thrust," has been developed to strengthen gluteal muscles. The gluteal bridge is a complex movement because it requires the person to perform multiple movements in a specific sequence. The gluteal bridge is typically performed when a person, user or individual is in the supine position on the ground or on a mat where the person's the hips and knees are flexed while the lower back is pressed flat on the ground. The person then performs a pelvic tilt, whereby the pelvis is moved or "rolled" toward the posterior and the lower back flattens. With the pelvic tilt engaged, the person then raises his or her buttocks and shifts weight to the feet and an area of the upper thorax located at the inferior aspect of the person's scapulae. When properly performing the gluteal bridge exercise, the person moves only at the hips, without bending the spine. Also, when a person performs the gluteal bridge in this manner, it is commonly referred to as an "unresisted" exercise since no external resistance is being applied during the complex movement.

As an individual becomes proficient at the basic gluteal bridge, the gluteal muscles become stronger. Various forms of resistance may be added to the gluteal bridge movement to increase the load on the gluteal muscles and other muscles. Safely increasing the load on the gluteal muscles is an important step in building overall muscular strength, endurance, power and girth. When resistance, e.g, in the form of an elastically deformable band, or some form of weight resistance such as a barbell, weight plate or dumbbell is applied to the exercise it is referred to as a "resisted gluteal bridge."

Past attempts to provide a resisted gluteal bridge include the use of additional devices, such as stretching a strongly-resistive elastic resistance band across a lower portion of a person's abdomen, along with contorting the person's knees to a severe angle to position the pelvis low enough to properly affix the elastic resistance band. Some attempts require the person to maneuver between a seat and a lower leg pad prior to initiating the exercise, creating dangers to the person, especially when he or she becomes fatigued. Other attempts require the person to press against a bare metal bar, typically while adding some form of an external pad, with their abdomen and contort their body to slide under the bar before initiating the gluteal bridge exercise. Further attempts require the use of hand-held free weights and a free-standing bench, presenting issues pertaining to the stability, strength and sliding resistance of the bench along a ground surface. Still further attempts rely on the compromised directional stability and support of an exercise ball. Even further attempts rely on the use of a smith machine, which creates a movement pathway that forces the user to move in an undesired vertical path (i.e., straight up and down) motion rather than a proper curvilinear path. The use of these additional devices to perform a resisted gluteal bridge causes numerous problems that reduce the effectiveness of the exercise while exposing the person trying to perform the exercise to potential injury. For example, these conventional resisted gluteal bridge exercises do not properly support the lumbar spine throughout the exercise's range of motion. Accordingly, these conventional exercises force the lumbar spine into a position of hyperextension, particularly at an end range of motion of the exercise which places significant pressure on a user's facet joints. This pressure is undesirable because it is a noted cause of lower back pain. Additionally, these conventional resisted gluteal bridge exercises do not allow the user to perform a resisted gluteal bridge with only one leg at a time, or a resisted gluteal bridge with alternating legs because the weight shifts in an uncontrolled and manner across the user's pelvis, which may cause the user to fall or become injured.

Accordingly, there has been a long-standing, unmet need for an exercise apparatus specifically designed to allow a person to properly perform a resisted gluteal bridge to improve the strength of a person's human posterior hip and gluteal muscles.

SUMMARY OF THE INVENTION

The present disclosure provides an exercise apparatus specifically designed to allow a person or user to perform a gluteal bridge, typically with resistance, to improve the strength of a person's human posterior hip and gluteal muscles. The exercise apparatus can be configured for use in different environments—namely, in a gym, fitness center or training facility, in a spa or studio, or in a home gym. In its different versions, the exercise apparatus facilitates the performance of a resisted gluteal bridge in a safe, controlled and efficient manner while the person lies on a bench of the apparatus. In use, the person lies along the length of the bench instead of perpendicular to the bench. Due to the added support of the bench under the length of the person's spine, the exercise apparatus protects the person's spine by maintaining the lumbar spine in a neutral position throughout the entire range of motion of the exercise, and also allows the motion of the exercise to be concentrated at the person's hip joints. Maintaining the lumbar spine in the neutral position and concentrating motion at the hip joints (i) eliminates any undesirable accessory movement in the spine, where accessory movement is movement created between the various segments of the user's spine, including at the facet joints or between the vertebral bodies, and (ii) improves the overall effectiveness of the resisted gluteal bridge exercise performed on the apparatus. Due to its unique configuration, the exercise apparatus also protects the user's pelvic bones from pressure that occurs when a heavy weight plate, barbell or dumbbells are placed across the upper portion of the user's hips, as done with conventional attempts to perform resisted gluteal bridges.

In one implementation, the exercise apparatus for performing a resisted gluteal bridge movement is intended for use in a gym, fitness center or training facility. The exercise apparatus generally comprises (i) a support assembly with a frame assembly and a deck assembly; (ii) a bench assembly; and, (iii) a resistance assembly, such as a weight stack operably connected to the bench assembly by a resistance member, such as a cable. The exercise apparatus is designed to be placed on a planar support surface or floor within the gym, fitness center or training facility. The user or person selects a level of resistance on the resistance assembly, secures himself/herself to the bench assembly and then performs at least one repetition of the resisted gluteal bridge movement. Typically, the user performs multiple repetitions of the resisted gluteal bridge movement as part of his/her training regimen. The configuration of the exercise apparatus for use in a peripheral gym environment, a spa or studio omits the weight stack but retains a resistance member, such as an elastically deformable band. The configuration of the exercise apparatus for use in a home gym also omits the weight stack while retaining the resistance member, and includes additional functionality, including the bench assembly being securable in a substantially horizontal position and the apparatus being collapsible to facilitate storage when not in use.

Other features and advantages of the disclosure will be apparent from the following specification taken in conjunction with the following drawings.

BRIEF DESCRIPTION OF THE DRAWINGS

The figures depict one or more implementations in accord with the present teachings, by way of example only, not by way of limitation. In the figures, like reference numerals refer to the same or similar elements.

DETAILED DESCRIPTION

Figure 1:
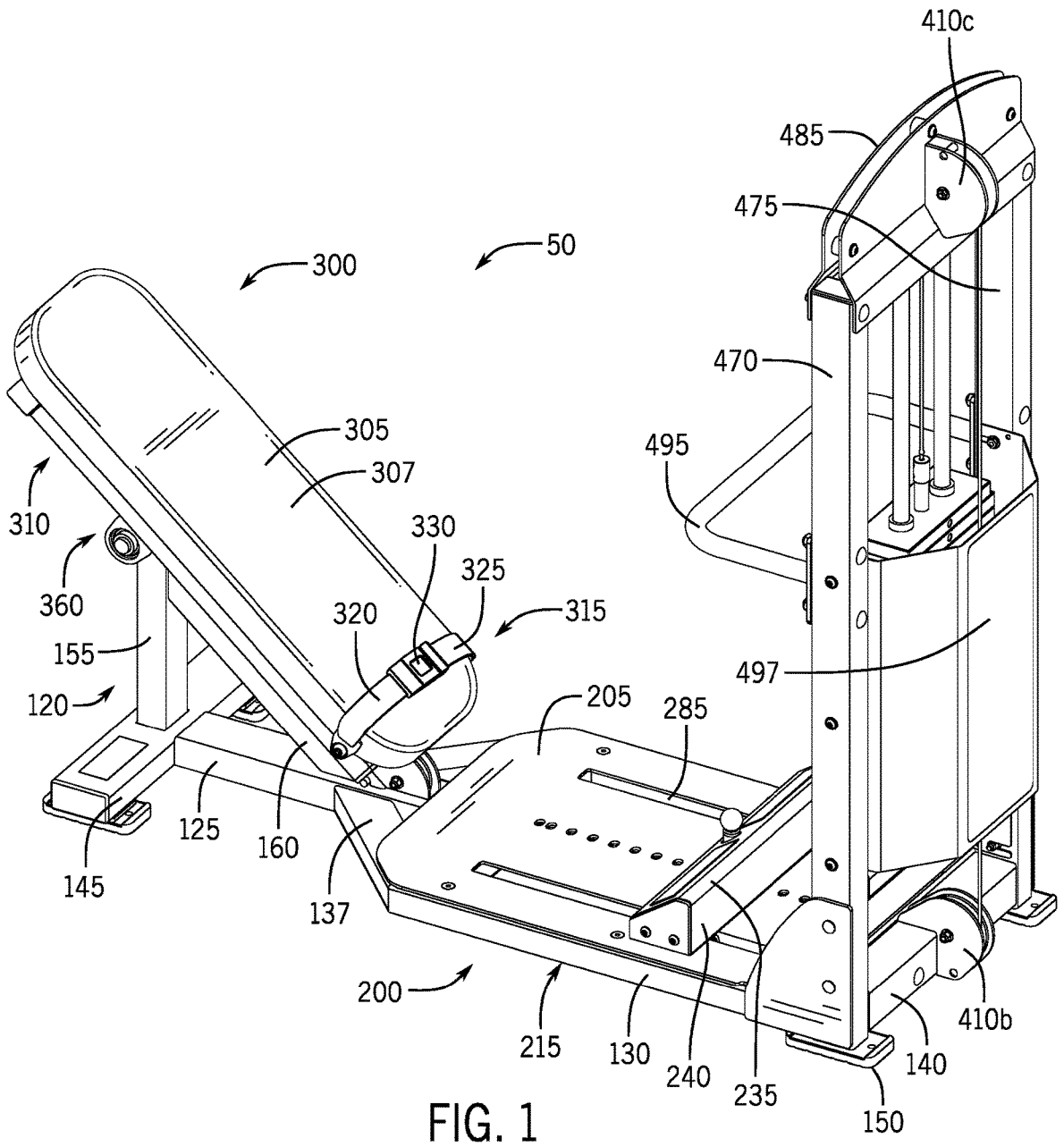
FIG. 1 is a first perspective view of an embodiment of an exercise apparatus for performing a gluteal bridge movement, showing the exercise apparatus in a first position where the apparatus is ready to use.

While this disclosure includes a number of details and implementations in many different forms, there is shown in the drawings and will herein be described in detail particular implementations with the understanding that the present disclosure is to be considered as an exemplification of the principles of the disclosed methods and systems, and is not intended to limit the broad aspects of the disclosed concepts to the implementations illustrated.

This disclosure relates to an exercise apparatus specifically designed to allow a person or user to perform a gluteal bridge, typically with resistance, to improve the strength of a person's human posterior hip and gluteal muscles. FIGS. 1-31, show versions of the exercise apparatus 10 for use in different environments—namely, in a gym, fitness center or training facility, in a spa or studio, or in a home gym. In its different versions, the exercise apparatus facilitates the performance of a resisted gluteal bridge in a safe, controlled and efficient manner while the person lies on a bench of the apparatus. In use, the person lies along the length of the bench instead of perpendicular to the bench. Due to the added support of the bench under the length of the person's spine, the exercise apparatus protects the person's spine by maintaining the lumbar spine in a neutral position throughout the entire range of motion of the exercise, and also allows the motion of the exercise to be concentrated at the person's hip joints. The lumbar spine consists of five vertebrae labeled L1 through L5, and it is situated between the thoracic spine and the sacrum. Maintaining the lumbar spine in the neutral position and concentrating motion at the hip joints eliminates any accessory movement, as defined above in the Summary section, through the entire spine while improving the overall effectiveness of the resisted gluteal bridge exercise performed on the apparatus. Due to its unique configuration, the exercise apparatus also protects the user's pelvic bones from pressure that occurs when a heavy weight plate, barbell or dumbbells are placed across the upper portion of the user's hips, as done with conventional attempts to perform resisted gluteal bridges.

FIGS. 1-11 depict a first embodiment of the apparatus 50 for performing a resisted gluteal bridge movement that is configured for a heavy-use environment, such as in a gym, fitness center or training facility. The exercise apparatus 50 generally comprises (i) a support assembly 100 with a frame assembly 120 and a deck assembly 200; (ii) a bench assembly 300; and, (iii) a resistance assembly 400. The exercise apparatus 50 is designed to be placed on a planar support surface or floor F within the gym, fitness center or training facility. As described in greater detail below, the user or person selects a level of resistance on the resistance assembly 400, secures himself/herself to the bench assembly 300 and then performs at least one repetition of the resisted gluteal bridge movement. Typically, the user performs multiple repetitions of the resisted gluteal bridge movement as part of his/her training regimen.

Referring to FIGS. 1-11 and as mentioned above, the support assembly 100 includes the frame assembly 120 and the deck assembly 200. The frame assembly 120 comprises a primary or central member 125 and two side members—first side member 130 and second side member 135 that extend via a transition member 137 from the primary member 125. As seen in the bottom view of FIG. 8, the transition member 137 is oriented at an angle to the primary member such that the primary member 125 and the side members 130, 135 are substantially parallel to each other. A front member 140 extends between and connects the primary member 125 and the first and second side members 130, 135. A rear member 145 extends from the primary member 125. As shown in FIGS. 1-11, the rear member 145 is transverse to the primary member 145 such that these two members are substantially perpendicular to each other. The front member 140 and the rear member 145 are shown as having a linear configuration so they provide cross member support, however, the front member 140 and/or rear member 145 can have a curvilinear configuration.

The frame assembly 120 also includes a plurality of mounting feet 150 that engage the supporting floor F and that are configured to increase the stability of the apparatus 50 during usage. The mounting feet 150 preferably have an elastomeric composition and can compensate if the floor F that apparatus 50 is placed upon is not level. In the embodiment of FIGS. 1-11, a pair of mounting feet 150 are affixed to the front member 140 and a pair of feet 150 are affixed to the rear member 145. The frame assembly 120 further includes a rear vertical member 155 that extends upward from the rear member 145. Alternatively, the rear vertical member 155 extends upward from a rear portion of the primary member 125 or the junction of both the rear member 145 and the primary member 125. An angled support member 160 extends between the rear vertical member 155 and the primary member 125. In the embodiment of FIGS. 1-11, the angled member 160 extends from an upper portion of the vertical member 155 to an intermediate portion of the primary member 125.

Figure 2:
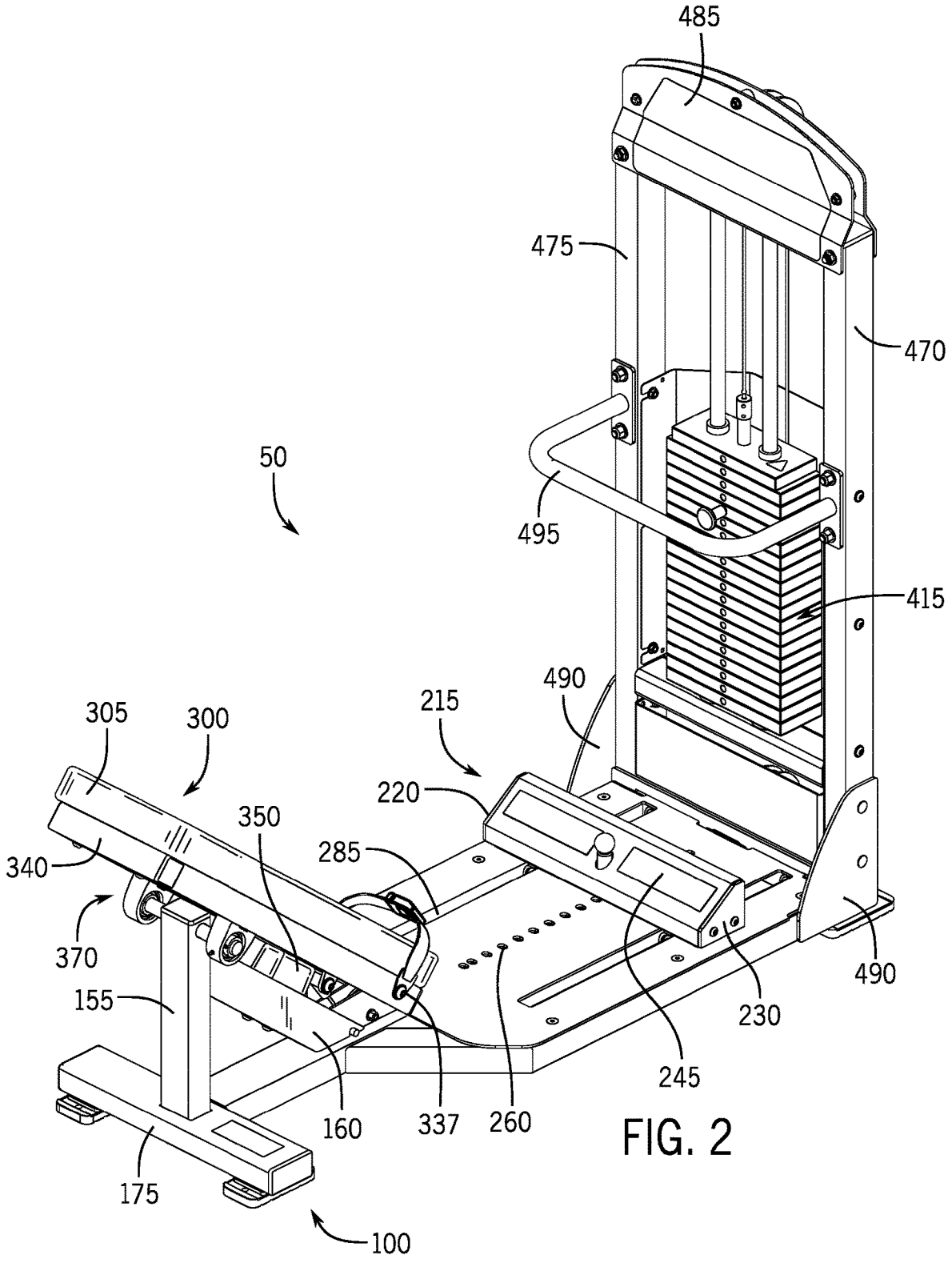
FIG. 2 is a second perspective view of the exercise apparatus of FIG. 1.
Figure 3:
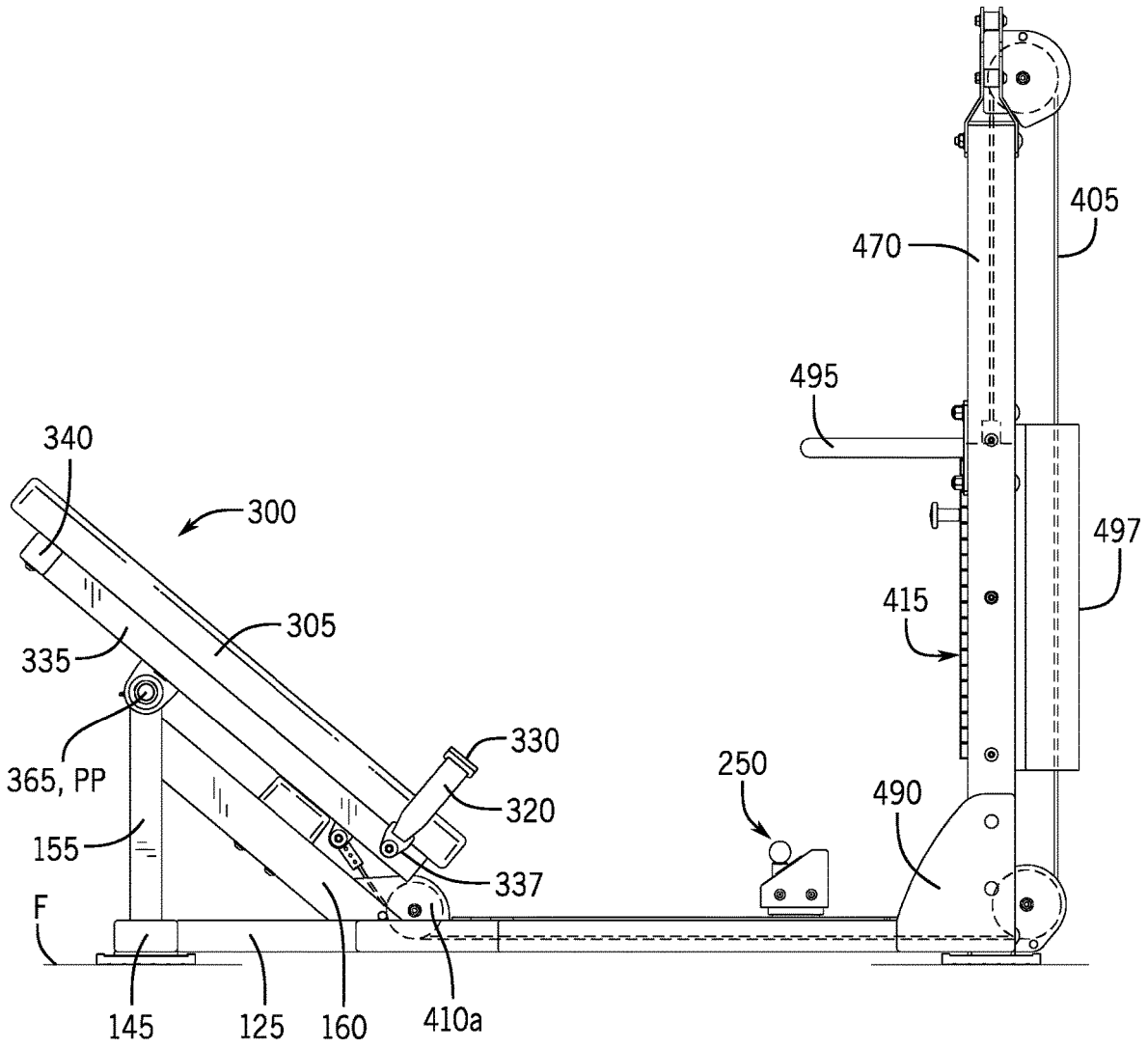
FIG. 3 is a first side view of the exercise apparatus of FIG. 1.
Figure 4:
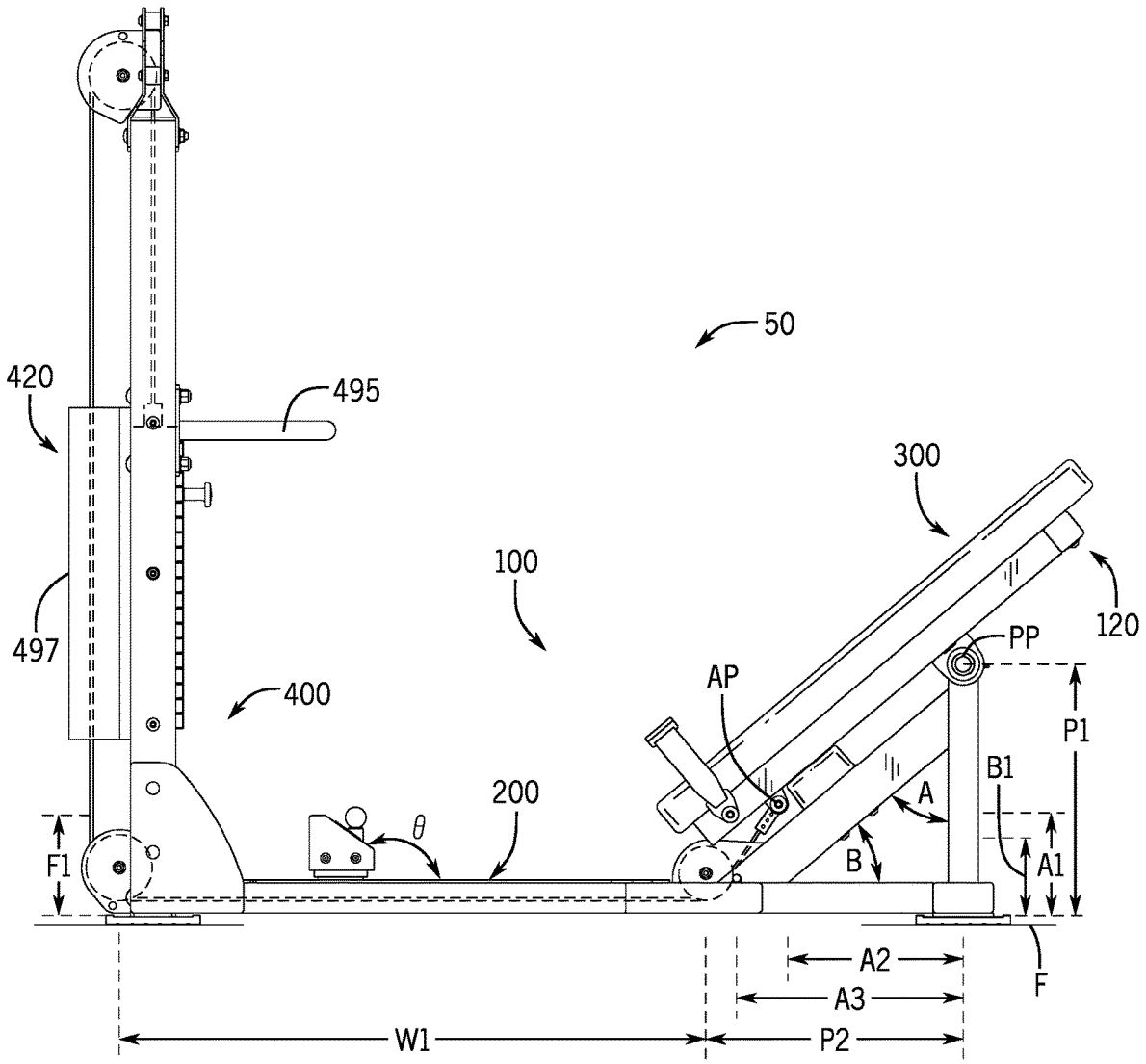
FIG. 4 is a second side view of the exercise apparatus of FIG. 1.
Figure 5:
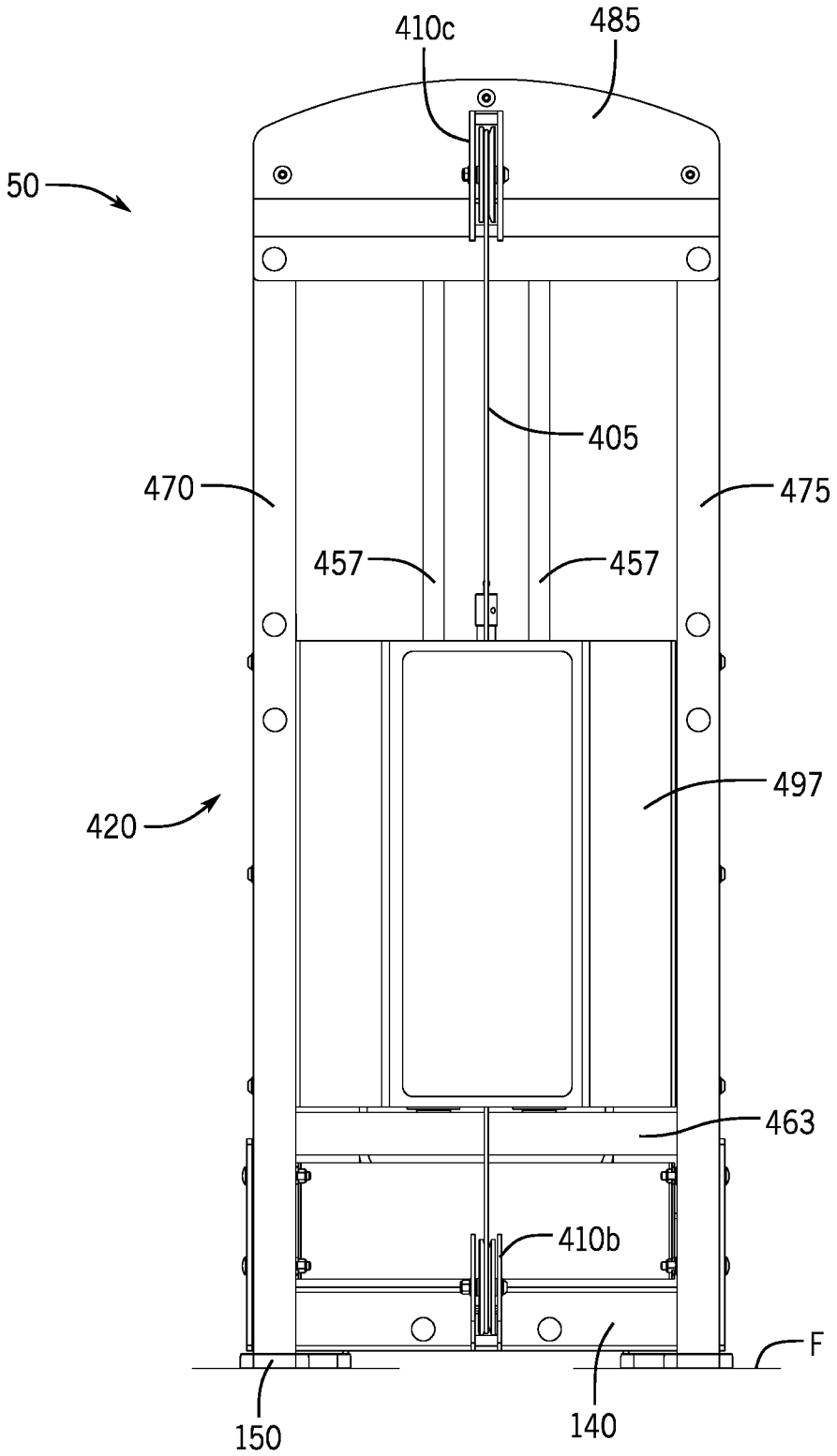
FIG. 5 is a front view of the exercise apparatus of FIG. 1.
Figure 7:
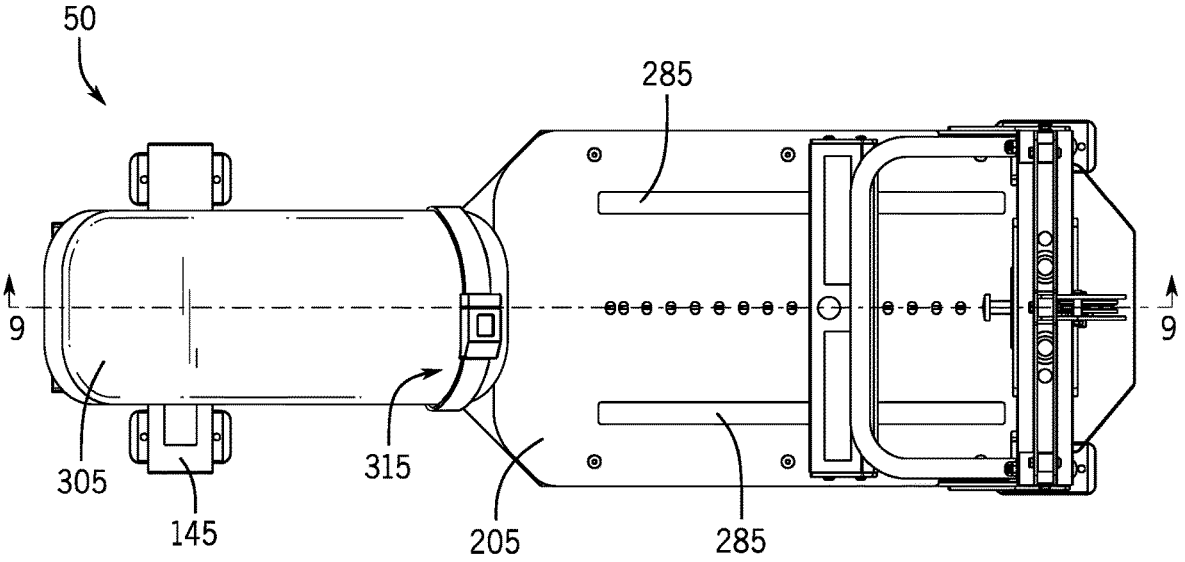
FIG. 7 is a top view of the exercise apparatus of FIG. 1.
Figure 8:
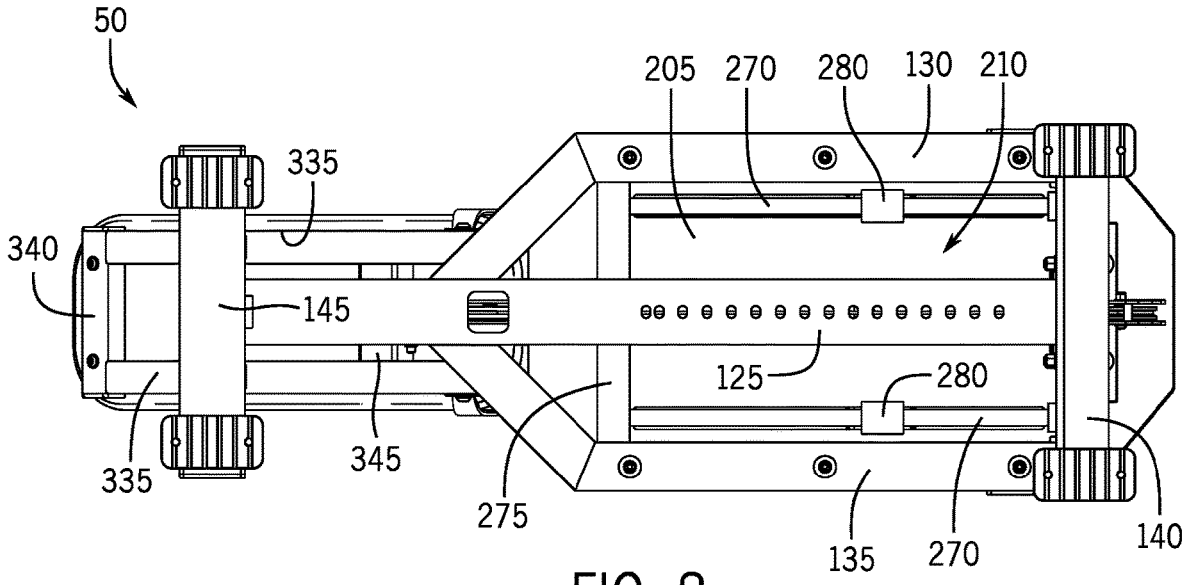
FIG. 8; is a bottom view of the exercise apparatus of FIG. 1.
Figure 9A:
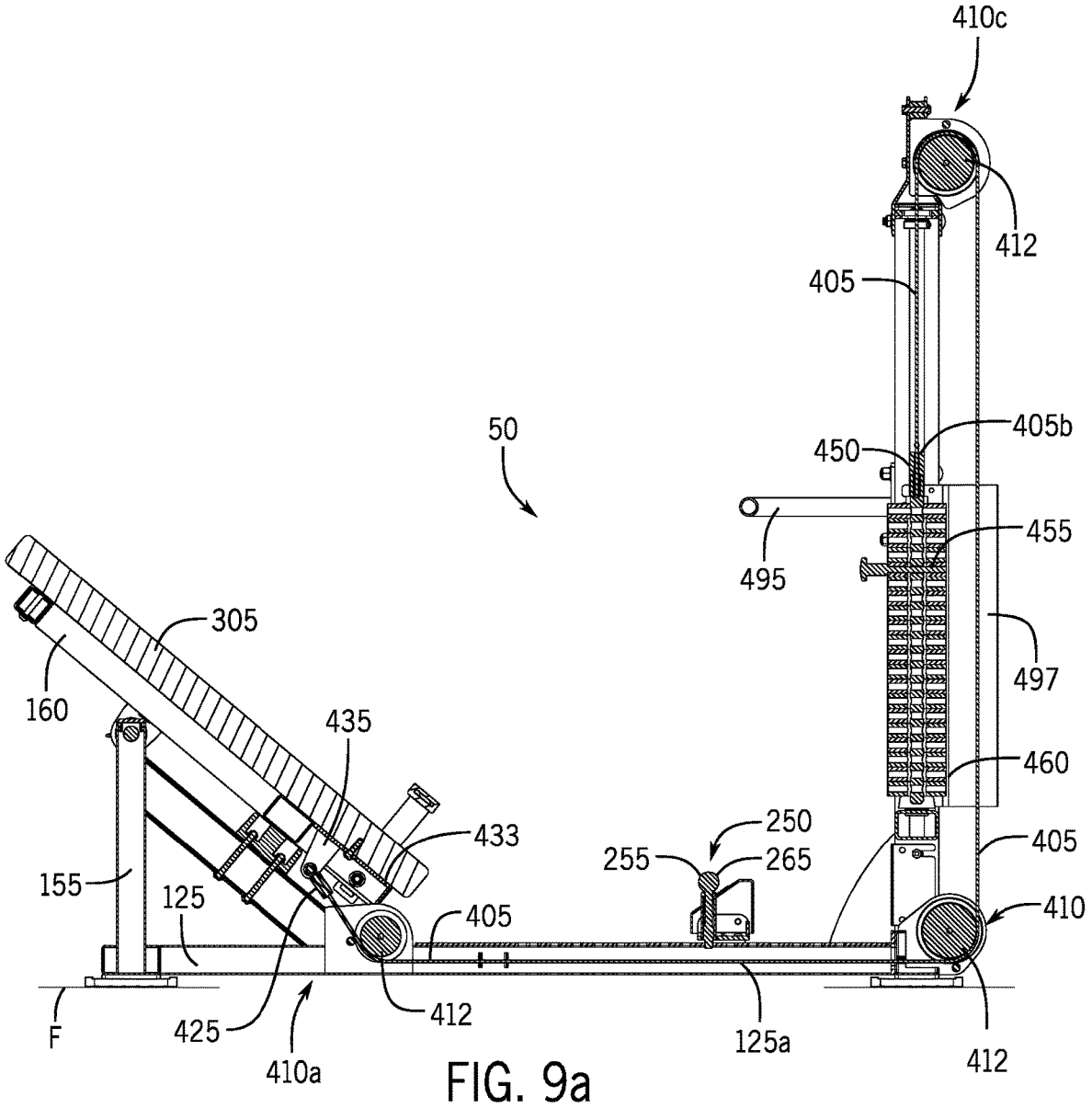
FIG. 9A is a section view of the exercise apparatus of FIG. 1, taken along line 9-9 of FIG. 7.
Figure 9B:
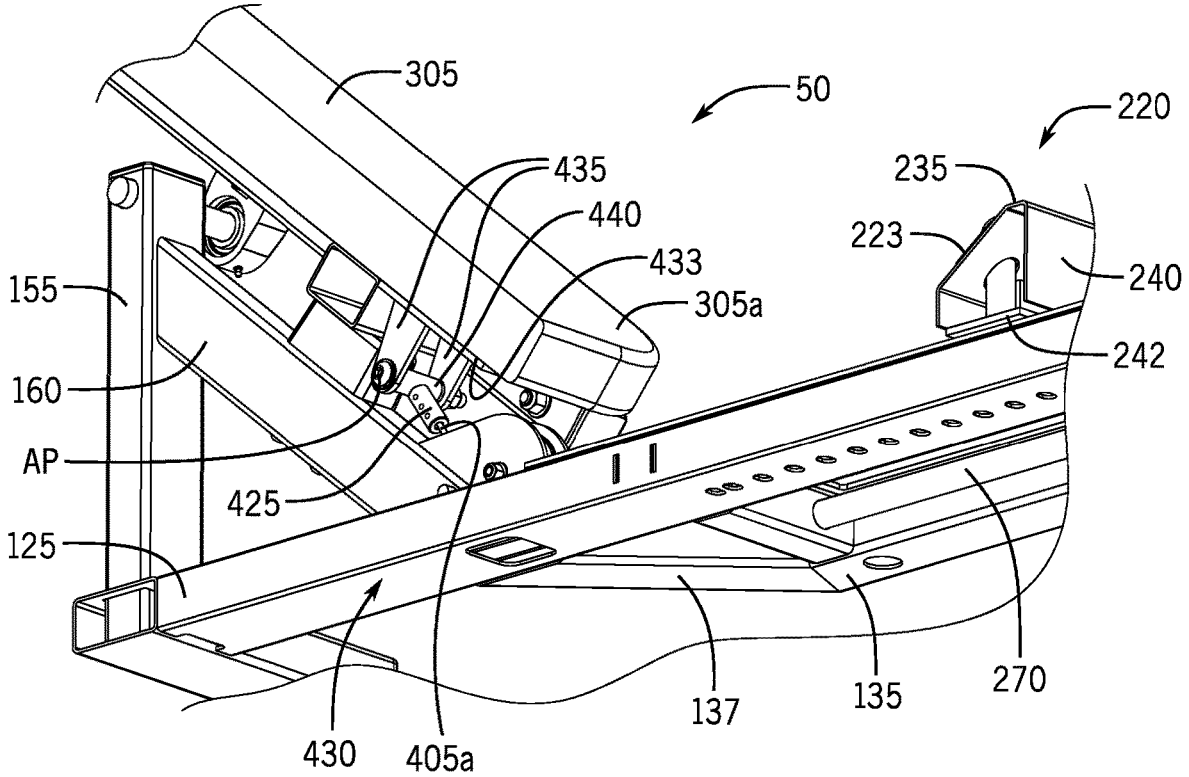
FIG. 9B is a partial section view of the exercise apparatus of FIG. 1, taken along a line through the bench assembly.

The deck assembly 200 comprises an upper plate member 205, preferably horizontally arranged relative to the floor F, that extends over an extent of the primary member 125 and the side members 130, 135 to define a cavity 210 there between (see FIG. 9). The deck assembly 200 is intended to be a low-profile structure to facilitate the user's U ingress and egress from the apparatus 50. As such, the plate member 205 is positioned close to the support surface or floor F upon which the apparatus 50 is placed, where an upper surface of the plate member 205 and the floor F is less than 5 inches, preferably less than 4 inches and most preferably 3 inches. These dimensions represent the height of the plate member 205 to the floor F and include the mounting feet 150. An adjustable foot rest assembly 215 is connected to the deck assembly 200 and is configured to engage the feet of people using the apparatus 50. In the embodiment of FIGS. 1-11, the foot rest assembly 215 slides along the upper surface of the plate member 205 such that the distance between the foot rest assembly 215 and the bench assembly 300 can be varied by about 20 inches, and preferably 22 inches, to accommodate different sized people. The foot rest assembly 215 includes a wall arrangement 220 having a rear wall 240, opposed side walls 230, a top wall 235, a front wall 225 extending between the side walls 230, and a bottom wall 242 extending between the side walls 230 (as best shown in FIG. 9B). The front wall 225 is configured to engage and support the feet of the person using the apparatus 50. Preferably, the front wall 225 is angled, sloped or curved relative to the plate member 205. The front wall 225 can include means for enhancing the engagement with the person's feet, wherein the engagement means is textured treads 245, projections formed on the wall 225, or recess formed in the wall 225. As shown in FIGS. 3 and 4, the wall 225 is sloped and extends from the upper plate member 205 at an angle θ that is 130 to 150 degrees, preferably 145 degrees. Due to the low-profile configuration of the deck assembly 200, the top wall 235 is positioned close to the supporting floor F, meaning that the top wall 235 is within 10 inches, preferably within 9 inches and most preferably within 7.5 inches of the supporting floor F (where these dimensions include mounting feet 150 secured to the frame assembly 120). As such, the adjustable foot rest assembly 215 does not compromise the user's U ingress and egress to the bench assembly 300.

The foot rest assembly 215 further includes a releasable adjustment mechanism 250 that allows for selective positioning of the foot rest assembly 215 along the deck assembly 200. The adjustment mechanism 250 includes a pin 255, preferably spring-loaded, that extends through rear wall 240 and apertures 260 formed in the plate member 205. As shown in FIGS. 1, 2 and 7, the plate member 205 has a plurality of substantially aligned apertures 260 that are configured to receive a lower portion of the pin 255. A knob 265 is affixed to an upper portion of the pin 255 whereby the person can grasp the knob 265 and apply a substantially upward force thereby displacing the pin 255 from its existing aperture 260 and allow for repositioning of the foot rest assembly 215. Once the desired location of the foot rest assembly 215 is attained, the person can release the knob 265 such the pin 255 engages and is received by the aperture 260 at the desired location.

The deck assembly 200 also includes at least one rail 270 that resides within the internal cavity 210 and that operably supports the adjustable foot rest assembly 215. In the embodiment of FIG. 8, the deck assembly 200 includes a pair of elongated rails 270, each rail extending between the front member 140 and an intermediate cross member 275, which itself extends between the primary member 125 and the side member 130, 135. The bottom wall 242 of the foot rest assembly 215 is coupled by a plurality of elongated fasteners (e.g., bolts) to a projection (not shown) affixed to a collar 280 that is located within the cavity 210 and that is in sliding engagement with the rail 270. In this manner, the collar 280 has an inner diameter that slightly exceed the outer diameter of the rail 270. The collar 280 includes an inner bushing that facilitates sliding movement between the collar 280 and the rail 270. As shown in FIGS. 1, 2 and 7, the upper plate member 205 includes at least one slot 285 that extends between the intermediate cross member 275 and the front member 140. The slot 285 is dimensioned to accommodate the elongated fasteners that couple the collar 280 to the foot rest assembly 215 such that the fasteners can move freely within the slot 285 as the foot rest assembly 215 is moved fore and aft along the plate member 205 to vary the distance between the foot rest assembly 215 and the bench assembly 300 in order to accommodate different sized people who desire to use the apparatus 50.

Figure 10:
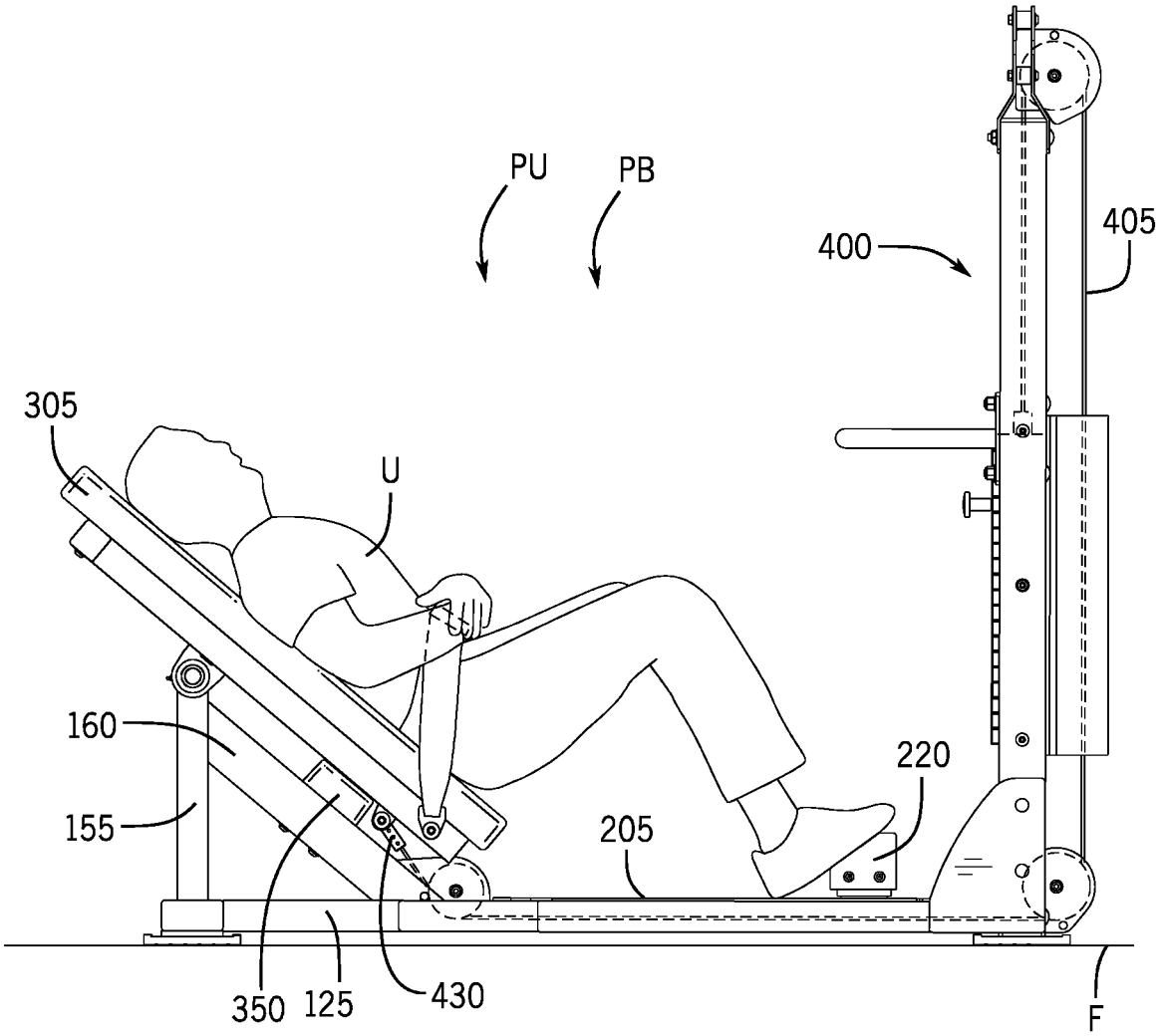
FIG. 10 is a side view of the exercise apparatus of FIG. 1, showing the exercise apparatus in a second position where a person is in a ready to use position and perform a gluteal bridge exercise.
Figure 11:
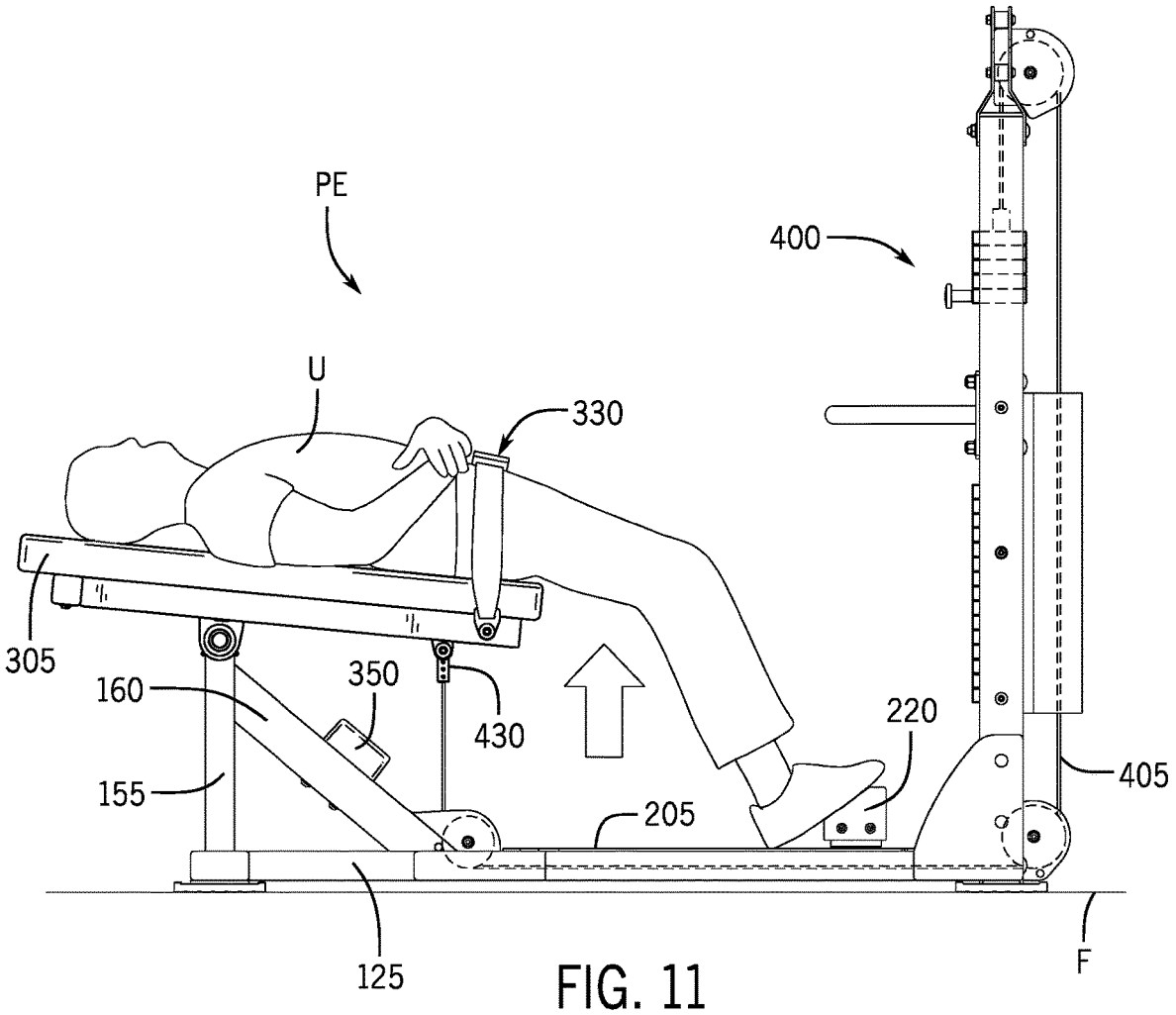
FIG. 11 is a side view of the exercise apparatus of FIG. 1, showing the exercise apparatus in a third position where the user's hips are in an extended position while performing a gluteal bridge exercise.

The bench assembly 300 of the exercise apparatus 50 comprises a bench 305, a bench support frame assembly 310 and a belt assembly 315. The bench 305 has a substantially rectangular configuration with internal pad member residing within an external housing 307. The belt assembly 315 includes a first member 320, a second member 325 and a buckle 330 to operably connect the first and second members 320, 325. The belt assembly 315 is operably connected by a coupler 337 to the support frame assembly 310 near a lower end 305*a* of the bench 305. As shown in FIGS. 10 and 11 and as explained below, the user secures the belt assembly 315 across his/her lower abdomen before commencing the gluteal bride exercise. Unlike some conventional devices, the apparatus 50 does not require additional structures above the bench assembly 300 and the belt assembly 315 to secure the user U to the bench 305, such as mechanical linkages or an elongated pad that extends across the user's abdominal region. The bench 305 is affixed to the support frame assembly 310 which includes side frame members 335, rear member 340, and intermediate cross member 345 (see FIGS. 6 and 8). Referring to FIGS. 2-4, an elastomeric bumper 350 is affixed to the frame assembly 120, preferably the angled member 160. The bumper 350 is configured to engage the intermediate cross member 345 when the bench 305 is lowered towards the angled member 160 while the user performs the gluteal bridge movement. In this manner the bumper 350 prevents the bench 305 from striking and potentially damaging the frame assembly 120, including the angled member 160, while various users perform gluteal bridge movements over prolonged periods of time. The bumper 350 has an overall height of at least 1.5 inches, and preferably 2.0 inches. Unlike some conventional devices, the apparatus 50 includes a single bench 305 that obviates the need for a secondary, typically lower, bench that assists a user with ingress and egress and/or further supports the user prior to and/or after the gluteal exercise movement.

Figure 6:
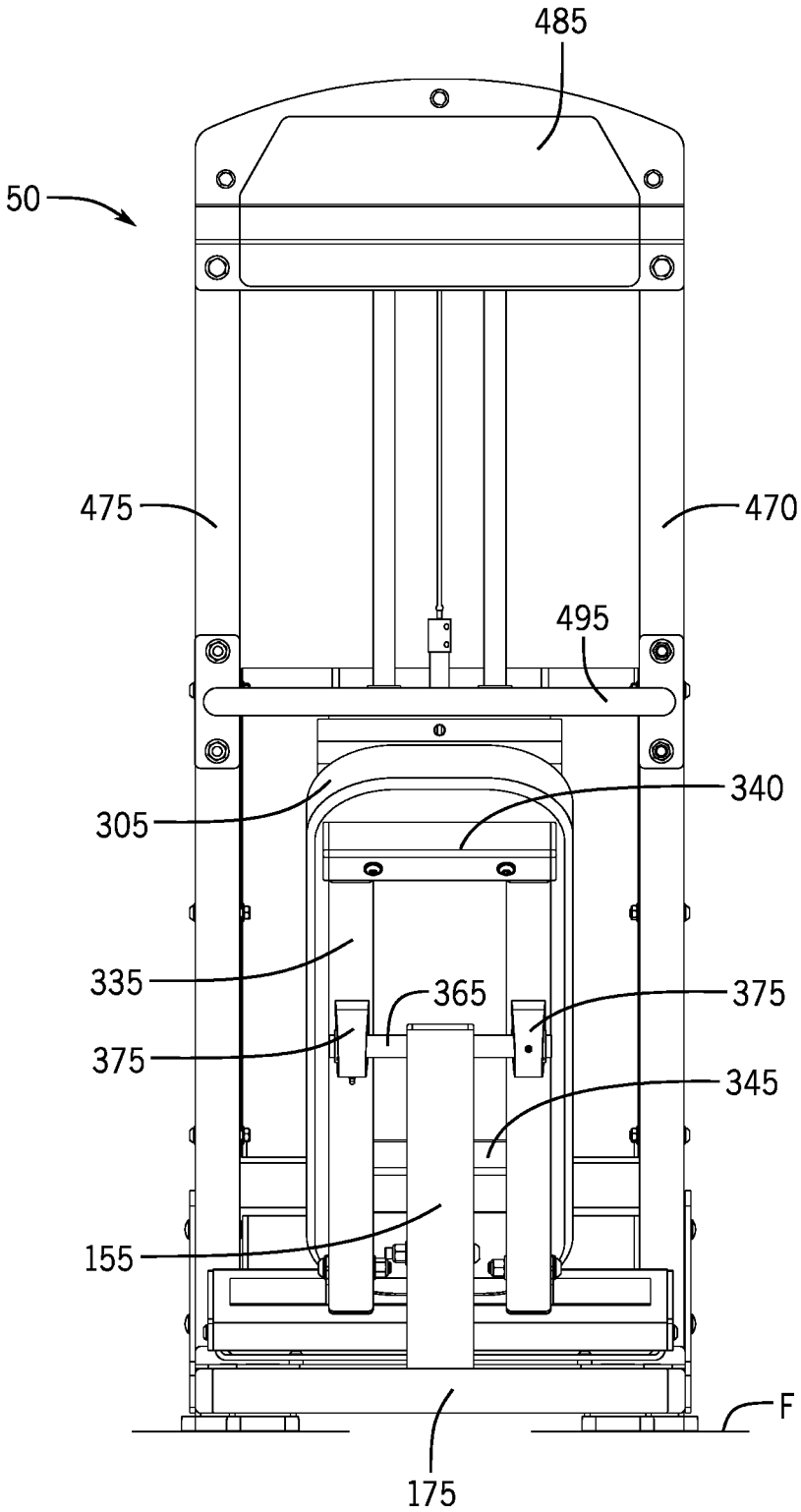
FIG. 6 is a rear view of the exercise apparatus of FIG. 1.

The bench assembly 300 is pivotally connected to the frame assembly 120 to allow for pivotal movement of the bench 305 and the bench support frame assembly 310 during the user's performance of the gluteal bridge exercise. Referring to FIGS. 1-4, 6 and 9, the bench assembly 300 includes at least one bearing assembly 360 that receives an extent of a rod 365 extending through an upper portion of the vertical member 155. The bearing assembly 360 includes an internal bearing set 370 mounted within a housing 375 that extends downward from the bench support frame assembly 310. The bearing assembly 360 is preferably a pillow block bearing with a curvilinear housing 375. As shown in FIG. 6, there are two bearing assemblies 360, each extending downward from an extent of the side frame member 335. In this configuration, the rod 365 extends from the vertical member 155 and an end segment of the rod 365 extends through the bearing set 370. Also in this configuration, the vertical member 155 is positioned between the bearing assemblies 360. The rod 365 defines a pivot point PP (see FIGS. 3 and 4) where the bench assembly 300 is pivotally connected to the frame assembly 120 to allow for pivotal movement of the bench 305 during performance of the gluteal bridge exercise. The pivot point PP is in an elevated vertical position relative to: (i) the support surface upon which the apparatus 50 rests, (ii) the deck plate member 205, (iii) an anchor point AP (as detailed below and shown in FIG. 4), and (iv) the foot rest assembly 215. This does not mean that the pivot point PP is directly above these other components; instead, the pivot point PP is located at a higher vertical elevation compared to these components. Accordingly, the vertical elevation of pivot point PP is greater than the anchor point AP, the deck plate member 205 and the foot rest assembly 215. In the embodiment of FIGS. 1-11, when the apparatus 50 is in the first position or ready to use position $P_U$, the engagement between the angled member 160 and the intermediate cross member 345, as provided by the bumper 350, and between the side frame member 335 and the vertical member 155, as provided by the bearing assembly 360, ensures that both the bench 305 and the side frame member 335 are substantially parallel to the angled member 160. This positional arrangement improves the stability of the bench 305 both when the user lays on the bench 305 to prior to securing the belt assembly 315 and beginning the first repetition of the gluteal bridge movement, and when the user is laying on the bench 305 while performing gluteal bridge movements.

As shown in FIGS. 1-11, the resistance assembly 400 of the exercise apparatus 50 comprises a cable 405, at least one pulley assembly 410 and a weight stack 415 supported by a frame assembly 420. The resistance assembly 400 provides a resistance force that the user U must overcome, in addition to the effects of gravity, in order to pivotally move the bench 305 from a first position (see FIG. 10) to a second position (see FIG. 11) about the pivot point. Referring to FIGS. 3, 4, 9A and 9B, a coupler 425 pivotally secures the first end 405*a* of the cable 405 to an anchor mechanism 430 extending downward from a support plate 433 (see FIG. 9) affixed to a lower surface of the bench assembly 300, namely the bench support frame assembly 310 and/or the bench 305. The anchor mechanism 430 comprises a pair of flanges 435 separated by a rod 440 to which the coupler 425 is pivotally connected. In this manner, the coupler 425 is pivotally connected to the rod 440 between the flanges 435, wherein the rod 440 defines an anchor point AP. The anchor point AP is in an elevated vertical position relative to: (i) the support surface upon which the apparatus 50 rests, (ii) the deck plate member 205, and (iii) the first pulley 410*a*. The anchor point AP is generally in the same vertical position as the foot rest assembly 215. The anchor point AP is in a lower vertical position relative to the pivot point PP. This does not mean that the anchor point AP is aligned directly above or directly below these other components; instead, the anchor point AP is located at different vertical elevations compared to these components. Accordingly, the vertical elevation of anchor point AP is between the pivot point PP and the deck plate member 205.

During the gluteal bridge movement, there is pivotal movement of the coupler 425 and the cable 405 about the anchor point AP as the bench 305 is elevated and lowered by the user. A first pulley assembly 410*a* is located at the lower end of the angled member 160 near its junction with the central member 125. The cable 405 is routed along the wheel 412 of the first pulley 410*a* that is rotatably supported by a housing 413 positioned proximate the central member 125. The first pulley 410*a* is oriented such that the cable 405 extends past the wheel 412 and through an internal cavity 125*a* of the central member 125 to a second pulley assembly 410*b* located at the base of the weight stack frame assembly 420. As shown in FIG. 9A, the internal cavity 125*a* has dimensions large enough that the pin 255 does not make contact with the cable 405 when the user actuates the release mechanism 250. The cable 405 extends from the second pulley 410*b* to a third pulley assembly 410*c* that resides within an upper extent of the weight stack frame assembly 420. In this manner, the cable 405 is routed around the wheel 412 of the third pulley assembly 410*c*. The arrangement of the first, second and third pulleys 410*a*, 410*b*, 410*c* provide a path of travel for the cable 405 that is substantially linear. A second end 405*b* of the cable 405 is operably secured to the weight stack 415 by a connector 450. This connector 450 couples the second cable end 405*b* to an elongated rod 455 that extends through the weighted plates 460 that comprise the weight stack 415, wherein the user can selectively chose the number and quantity of plates 460 that provide resistance during the performance of the resisted gluteal bridge exercise. The rod 455 includes apertures that are cooperatively positioned with apertures formed through the plates 460, wherein the user can insert a pin 465 through the plates 460 and into the rod 455 to select the amount of weighted resistance during the performance of the resisted gluteal bridge exercises. The rod 455 is flanked by a pair of guide posts 457 that extend through the plates 460, wherein the posts 457 slidingly engage the plates 460 when they are raised and lowered while the user performs resisted gluteal bridge exercises.

Referring to FIGS. 1-11, the support frame assembly 420 of the weight stack 415 also includes external vertical members 470, 475 that extend upward from the deck assembly 200, an upper header 485 that extends between the upper ends of the vertical members 470, 475 and thereby acts as a cross-member, and lower corner braces 490 affixed to the vertical member 470, 475 and one of the first and second side members 130, 135 to provide additional support to the frame assembly 420. The upper header 485 can include information and instructions about the apparatus 50 and how it is to be properly used to perform gluteal bridge exercises. The support frame assembly 420 also includes a grab member, which can be configured as U-shaped bar 495, to assist the user with ingress and egress from the bench 305, and a primary shroud 497 coupled to the vertical members 470, 475 and overlapping the weight stack 415. Below the primary shroud 497 is an intermediate cross member 463 that extends between the external vertical members 470, 475 and that supports the weight stack 415 and the plates 460. It should be understood that in alternative embodiments, the resistance assembly 400 could be a resistance band, a chain, a single weight, electric, hydraulic, pneumatic, spring or any combination of these embodiments along with a weight stack. For example, the resistance assembly 400 could include both a weight stack and resistance bands. In other alternative embodiments, the resistance assembly 400 may be a single weight that is permanently or releasably coupled to the bottom portion 305*a* of the bench. For example, a dumbbell or a weight plate may be attached to the bottom portion 305*a* of the bench. In further alternative embodiments, the resistance assembly 400 may be omitted for the apparatus 50.

There are numerous critical dimensions, angles and ratios of the components of the apparatus 50 to ensure that the user can perform gluteal bridge exercises in a highly productive, efficient and same manner. For example, the angle A formed between the vertical member 155 and the angled member 160 is 30 to 65 degrees, preferably 50 degrees. The angle B formed between the sloped member 160 and the primary member 125 is 25 to 60 degrees, preferably 40 degrees. Referring to FIG. 4, the center of the first pulley assembly 410*a* and the center of the second pulley assembly 410*b* (which corresponds to the axis of rotation of the wheel of the pulley) are configured to define a W1 distance, which is at least 30 inches, preferably 39 inches. Also, the pivot point PP is located at a distance of P1 from the bottom edge of the rear member 145, where P1 is at least 14 inches, preferably 16 inches. Also, the distance between the pivot point PP and the center of wheel 412 defines a distance of P2, which is at least 15 inches from, preferably 17 inches. The top wall 235 of the foot rest assembly 215 is positioned vertically below a pivot point PP and an anchor point AP. As shown in FIG. 4, the top wall 235 is located at a distance of F1 from the bottom edge of the primary member 125, where F1 is less than 8 inches, preferably 6.5 inches from that edge. This non-elevated foot rest assembly 215 helps ensure that the user is able to stabilize his/her feet on the plate member 205 while performing the resisted gluteal bridge exercise. In contrast, a foot rest that is elevated above the pivot point PP puts unnecessary strain on the user's torso, including his/her neck. Additionally, an elevated foot plate, coupled with the forces of gravity, creates a shear force between the bench and the user's body which can cause the user to inadvertently slide on the bench while attempting the bridge motion.

When the bench assembly 300 is in the first position or bottom position $P_B$ of FIGS. 1-9, the anchor point AP is located at a distance of A1 vertically above the bottom edge of the primary member 125, where A1 is at least 5 inches from that edge, preferably 7 inches. Also, when the bench assembly 300 is in the first or bottom position $P_B$, the anchor point AP is located at a distance of A2, which is at least 10 inches from the pivot point PP, preferably 12 inches from that point PP. Further, when the user is properly positioned on and secured to the bench assembly 300 with the belt assembly 315, a second or ready for use position $P_U$, which is shown in FIG. 10. In the ready for use position $P_U$, the user's U knees and hips are in a flexed position and his/her hips are not extended, meaning the user's hips are bent to an angle between 60 degrees and 110 degrees depending on the selected placement of users feet, which is shown in FIG. 10. When performing the gluteal bridge exercise, the user will attain a third or hip extended position $P_E$, which is shown in FIG. 11. When the user moves from the ready for use position $P_U$, to the hip extended position $P_E$, the anchor point AP is displaced in a substantially curvilinear motion as the bench assembly 300 pivots about the pivot point PP. In the hip extended position $P_E$, the anchor point AP is located at least 10 inches from the bottom edge of the primary member 125, and preferably 16 inches from that edge. Also, in the hip extended position $P_E$, the anchor point AP is located at a distance of A3, which exceeds distance A2 and which is at least 13 inches from the pivot point PP, and preferably at least 15 inches from that point. In other words, when the bench assembly 300 moves from the ready for use position $P_U$ to the hip extended position $P_E$, the anchor point AP travels along a curvilinear path that brings the anchor point AP more than 3 inches closer to the weight stack 415 than when the anchor point AP is in the ready for use position $P_U$.

These dimensions, angles and ratios are essential to the functionality of the apparatus 50 and its long-term operation for a number of reasons. First, these angles are essential to the design and layout of the exercise apparatus 50 to ensure that the bench assembly 300 is properly positioned relative to the supporting ground such that the person can access the bench assembly 300 and then perform the resisted gluteal bridge in a controlled, safe and effective manner. Second, the bench 305 is designed support the user's entire thorax, including the user's lumbar, thoracic, and cervical spines, in a neutral position throughout the entire range of motion of the exercise, which helps protect the user's spine and allows the motion of the exercise to be concentrated at the hip joints. Third, the operable configuration of the bench 305 to the vertical member 155 provides a pivot point PP generally aligned with an inferior aspect of the user's scapulae and the user's thoracic spine. When the user is properly positioned on the bench 305, the pivot point PP is located between thoracic vertebras T1 through 12 of the human spine, preferably between vertebrae T3-T9, and most preferably between vertebrae T5-T7.

The exercise apparatus 50 facilitates the performance of a resisted gluteal bridge by a user in a safe, controlled and efficient manner. FIG. 10 shows a user U in the second or ready for use position $P_U$, where the user U is lying on the bench 305 prior and FIG. 11 shows the user in the third or hip extended position $P_E$, which represents an upper state of the gluteal bridge movement. The exercise apparatus 50 is configured to protect the spine of the user U by maintaining the lumbar spine in a neutral position throughout the entire range of motion of the exercise, and also allows the bridging motion of the exercise to be concentrated at the user's hip joints. The apparatus 50 purposely eliminates any accessory movement through the user's spine and improves overall effectiveness of the resisted gluteal bridge exercise.

FIG. 10 shows the user U in the second position, which illustrates both (i) the ready for use position $P_U$ prior to the commencement of the exercise and (ii) the bottom position $P_B$ that is achieved after the user U performs one complete gluteal bridge movement. In the ready for use position $P_U$, the bumper 350 (see FIGS. 2-4) affixed to the angled support member 160 engages the cross member 345 (see FIGS. 6 and 8) of the bench 305. To properly use the exercise apparatus 50, the user U adjusts the foot assembly 215 to a suitable position and selects a resistance level on the weight stack 415. In particular, the user inserts the pin 465 through the plates 460 and into the rod 455 to select the amount of weighted resistance during the performance of the resisted gluteal bridge exercises. Once the amount of weight is selected, the user U sits near the end of the bench 305 and aligns the inferior portion of their scapulae at, or proximate the pivot point. Once the user U is positioned on the bench 305, the user U secures his or her hips and lower abdomen to the bench 305 via the belt assembly 315 and places his/her feet against the adjustable foot assembly 215. Once the belt members 320, 325 are connected via the buckle 330, the user adjusts the length of the first and/or second members 320, 325 to ensure that the belt assembly 315 properly secures the user to the bench 305 and attain the ready for use position $P_U$.

After the user U is secured to the bench 305, the user U utilizes their gluteal muscles and accessory muscles of the hip and thigh to drive and elevate his/her hips in a substantially upward direction, which as reflected by the upwardly directed arrow in FIG. 11. This upwardly directed movement by the user U causes the user's knees to move from a position of relative flexion towards a position of less flexion. Additionally, this upwardly directed movement by the user U causes the bottom portion **305*a* of the bench 305 to move upward and away from the deck assembly 200 while the bench 305 pivots around the pivot point PP. This upwardly directed movement by the user U also causes the anchor point AP to travel along a curvilinear path. This path will cause the anchor point AP to move from the position shown in FIGS. 1-10 to the position shown in FIG. 11, which is approximately 9 inches upward and approximately 3 inches closer to the weight stack 415. This travel by the anchor point AP in turn forces the cable 405 via the pulley assembly 410 to lift the selected amount of weight from the weight stack 415. It should be understood, that the more weight the user selects on the weight stack 415 the more force the user U will have to use to cause the bottom portion 305*a* of the bench 305** to move upward.

While the user's feet are engaged with the foot assembly 215, the user U continues driving upward until he/she reaches the third or hip extended position $P_E$. The hip extended position $P_E$ occurs for most users U when the angle between the bench 305 and the rear vertical member 155 is between 60 degrees and 100 degrees, and typically is 80 degrees. Also, once the user reaches this hip extended position $P_E$ the cable 405 is substantially parallel with the rear vertical member 155. Once the hip extended position $P_E$ is reached, the user U may hold or maintain this position for a period of time. After the user U has reached the hip extended position $P_E$, the user U allows the bottom bench portion **305*a* to move downward towards the deck assembly 200 until the cross member 345 (see FIGS. 6 and 8) makes contact with the bumper 350 (see FIGS. 2-4) whereby the bench 305 reaches the bottom position $P_B$. In this manner, the user U progresses from the ready for use position $P_U$ through the hip extended position $P_E$ and back to the bottom position $P_B$, where the progression through these three positions defines one complete repetition of the gluteal bridge exercise. After the user U completes the desired number of repetitions, the user U releases the buckle 330, which causes the first and second members 320, 325 to disengage from one another. The user U is then able to stand-up and exit from the exercise apparatus 50**.

FIGS. 12-19 depict a second embodiment of the apparatus 1050 for performing a resisted gluteal bridge movement that is configured for a heavy-to-medium use environment, such as in a gym, fitness center or training facility. The exercise apparatus 1050 generally comprises (i) a support assembly 1100 with a frame assembly 1120 and a deck assembly 1200; (ii) a bench assembly 1300; and, (iii) a resistance assembly 1400. The exercise apparatus 1050 is designed to be placed on a planar support surface or floor F within the gym, fitness center, training facility, or a home. As described in greater detail below, the user or person selects a level of resistance on the resistance assembly 1400, secures himself/herself to the bench assembly 1300 and then performs at least one repetition of the resisted gluteal bridge movement. Typically, the user performs multiple repetitions of the resisted gluteal bridge movement as part of his/her training regimen.

Referring to FIGS. 12-19 and as mentioned above, the support assembly 1100 includes the frame assembly 1120 and the deck assembly 1200. The frame assembly 1120 comprises: 1) two primary or central members 1125, 2) a front member 1140, 3) a middle cross member 1147, and 4) a rear member 1145. As seen in the bottom view of FIG. 17, the central members 1125 are substantially parallel to each other. Specifically, the front member 1140 and rear member 1145 extends from the central members 1125. Also, the middle cross member 1147 extends between the central members 1125. Based on this arrangement, the members 1140, 1147 and 1145 are substantially parallel to each other and are substantially perpendicular to the central members 1125.

The frame assembly 1120 may also include a plurality of mounting feet 1150 that engage the supporting floor F and that are configured to increase the stability of the apparatus 1050 during usage. The mounting feet 1150 preferably have an elastomeric composition and can compensate if the floor F that apparatus 1050 is placed upon is not level. In the embodiment of FIGS. 12-19, a pair of mounting feet 1150 are affixed to the front member 1140 and a pair of feet 1150 are affixed to the rear member 1145. The frame assembly 1120 further includes a rear vertical member 1155 that extends upward from the rear member 1145. An angled support member 1160 extends between the rear vertical member 1155 and the middle cross member 1147.

Figure 15:
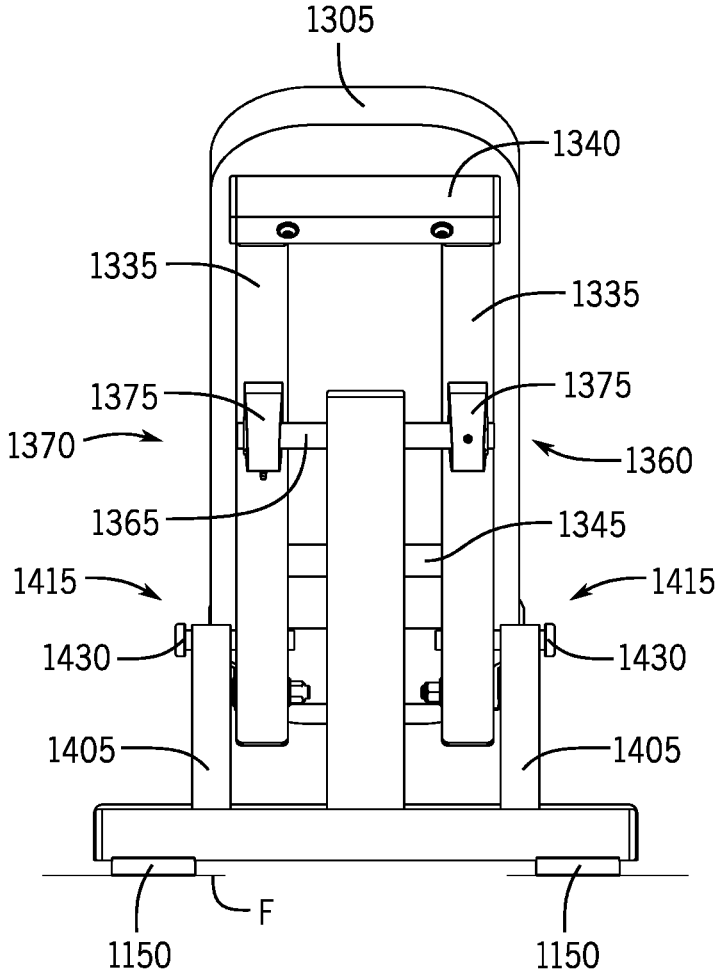
FIG. 15 is a rear view of the exercise apparatus of FIG. 12.
Figure 16:
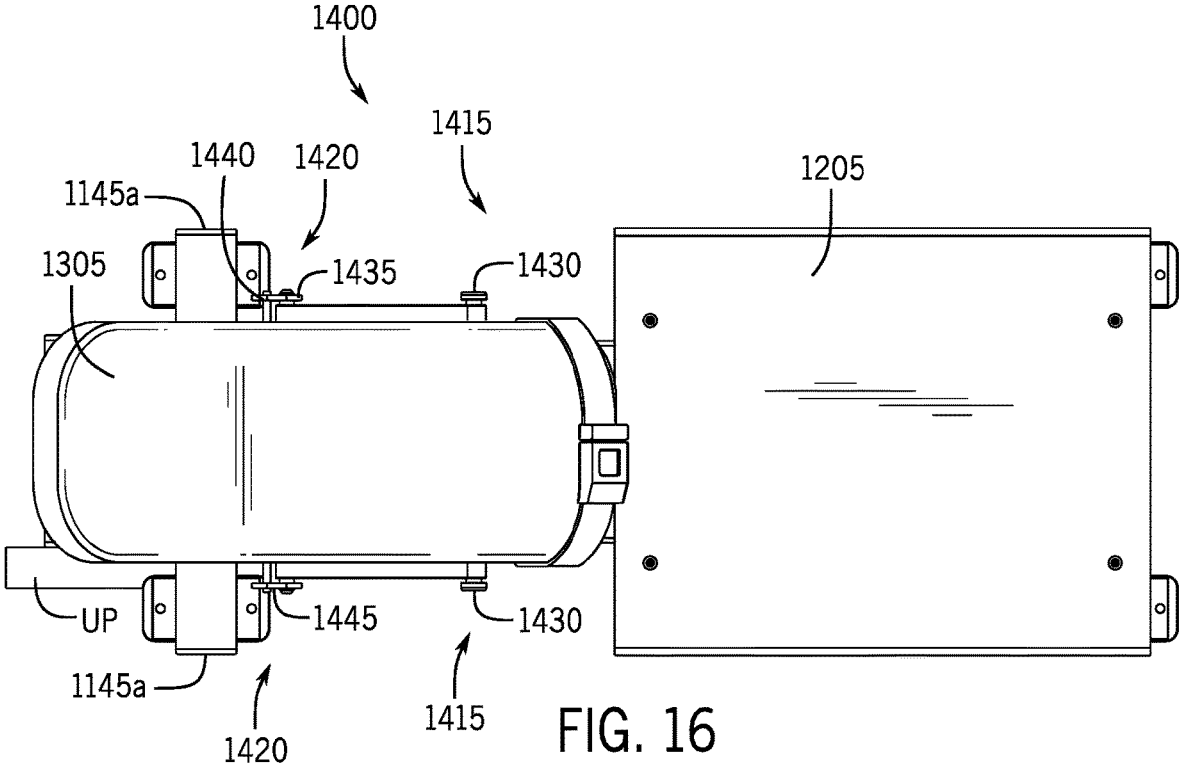
FIG. 16 is a top view of the exercise apparatus of FIG. 12.
Figure 17:
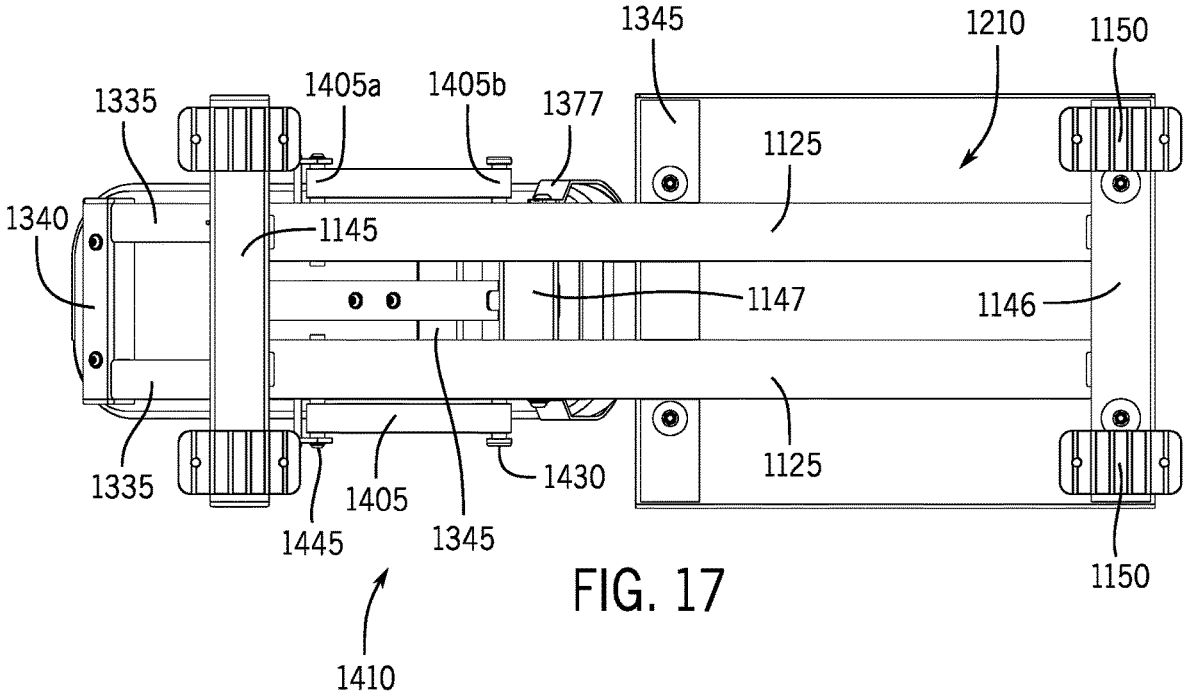
FIG. 17 is a bottom view of the exercise apparatus of FIG. 12.

The deck assembly 1200, preferably horizontally arranged relative to the floor F, comprises an upper plate member 1205 that extends over an extent of the central members 1125 to define a cavity 1210 there between (see FIG. 17). The deck assembly 1200 is intended to be a low-profile structure to facilitate the user's U ingress and egress from the apparatus 1050. As such, the plate member 1205 is positioned close to the support surface or floor F upon which the apparatus 50 is placed, where an upper surface of the plate member 1205 and the floor F is less than 5 inches, preferably less than 4 inches and most preferably 3 inches. These dimensions represent the height of the plate member 1205 to the floor F and include the mounting feet 1150. The deck assembly 1200 may have a non-skid surface placed over the upper plate member 1205 to help ensure that a user's feet do not slide during use of the apparatus 1050. In an alternative embodiment, an adjustable foot rest assembly that is similar to the foot rest assembly discussed above in connection with the first embodiment may be connected to the deck assembly 1200 and configured to engage the feet of the person that is using the apparatus 1050. As shown in the embodiment of FIGS. 12-19, the upper plate member 1205 is positioned below a pivot point PP (see FIG. 13) and below the bottom edge of the bench assembly 1300.

Figure 13:
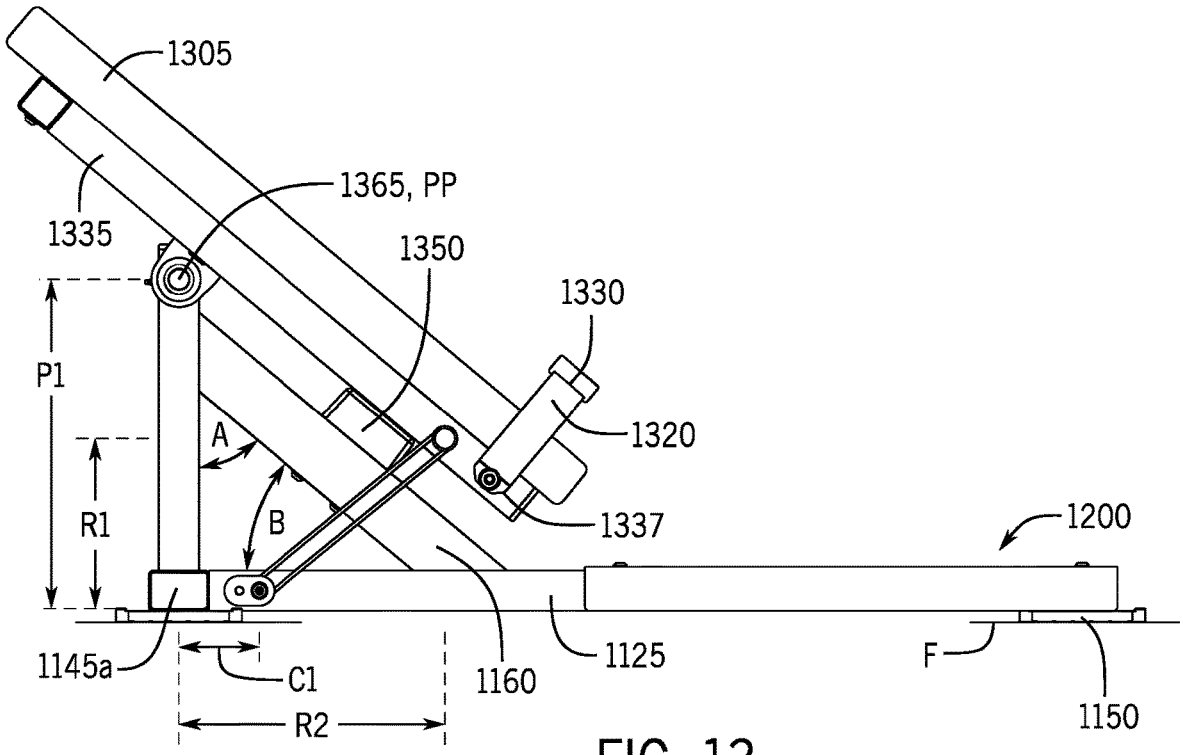
FIG. 13 is a side view of the exercise apparatus of FIG. 12.
Figure 14:
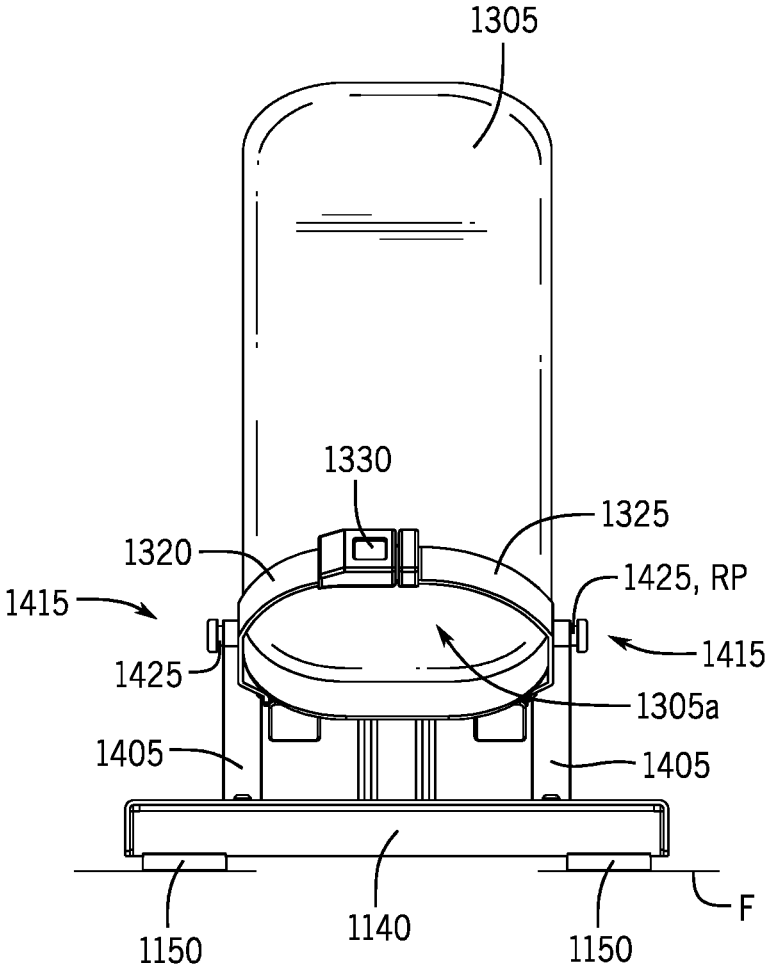
FIG. 14 is a front view of the exercise apparatus of FIG. 12.
Figure 18:
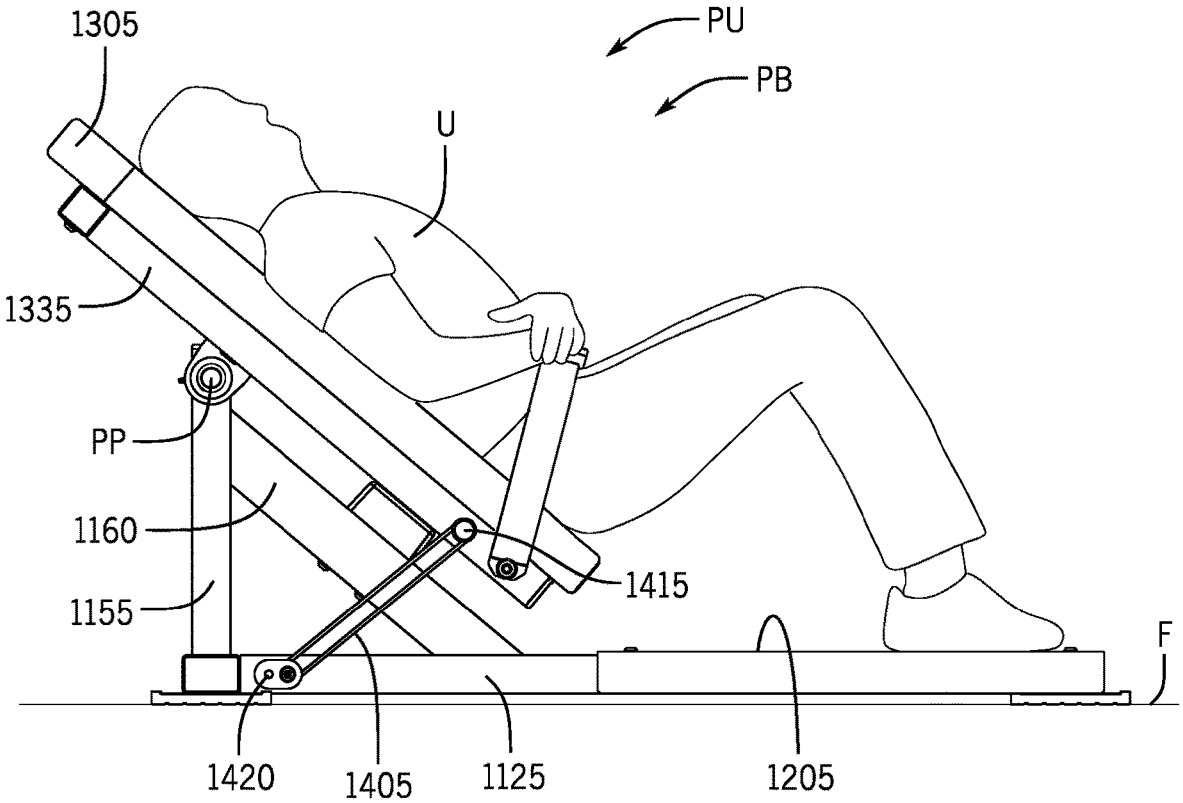
FIG. 18 is a side view of the exercise apparatus of FIG. 12, showing the exercise apparatus in a second position where a person is in a ready to use position and perform a gluteal bridge exercise.
Figure 19:
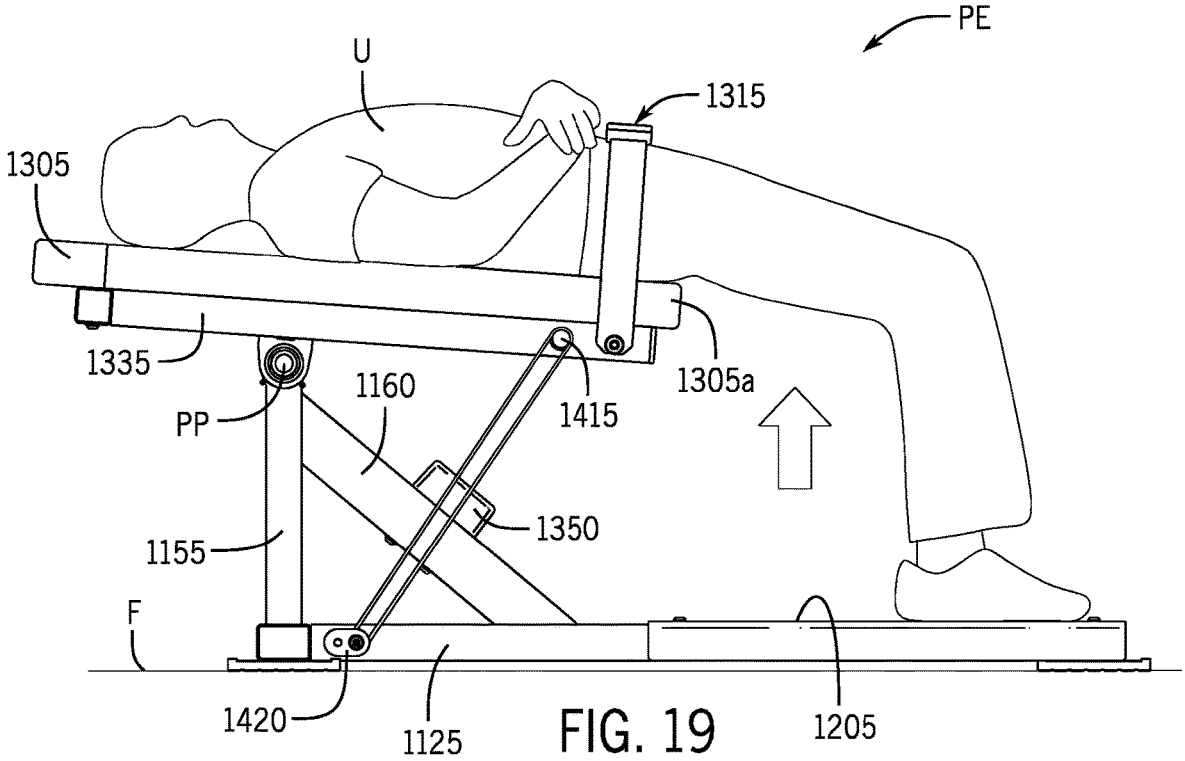
FIG. 19 is a side view of the exercise apparatus of FIG. 12, showing the exercise apparatus in a third position where the user's hips are in an extended position while performing the gluteal bridge exercise.

The bench assembly 1300 of the exercise apparatus 1050 comprises a bench 1305, a bench support frame assembly 1310 and a belt assembly 1315. The bench 1305 has a substantially rectangular configuration with internal pad member residing within an external housing 1307. The belt assembly 1315 includes a first member 1320, a second member 1325 and a buckle 1330 to operably connect the first and second members 1320, 1325. The belt assembly 1315 is operably connected by a coupler 1337 to the support frame assembly 1310 near a lower end 1305*a* of the bench 1305. As shown in FIGS. 18 and 19 and as explained below, the user secures the belt assembly 1315 across his/her lower abdomen before commencing the gluteal bride exercise. Unlike some conventional devices, the apparatus 1050 does not require additional structures above the bench assembly 1300 and the belt assembly 1315 to secure the user U to the bench 1305, such as mechanical linkages or an elongated pad that extends across the user's abdominal region. The bench 1305 is affixed to the support frame assembly 1310 which includes side frame members 1335, rear member 1340, and intermediate cross member 1345 (see FIGS. 15 and 17). Referring to FIG. 13, an elastomeric bumper 1350 is affixed to the frame assembly 1120, preferably the angled member 1160. The bumper 1350 is configured to engage the intermediate cross member 1345 when the bench 1305 is lowered towards the angled member 1160 while the user performs the gluteal bridge movement. In this manner the bumper 1350 prevents the bench 1305 from striking and potentially damaging the frame assembly 1120, including the angled member 1160, while various users perform gluteal bridge movements over prolonged periods of time. The bumper 1350 has an overall height of at least 1.5 inches, and preferably 2.0 inches. Unlike some conventional devices, the apparatus 1050 includes a single bench 1305 that obviates the need for a secondary, typically lower, bench that assists a user with ingress and egress and/or further supports the user prior to and/or after the gluteal exercise movement.

Figure 12:
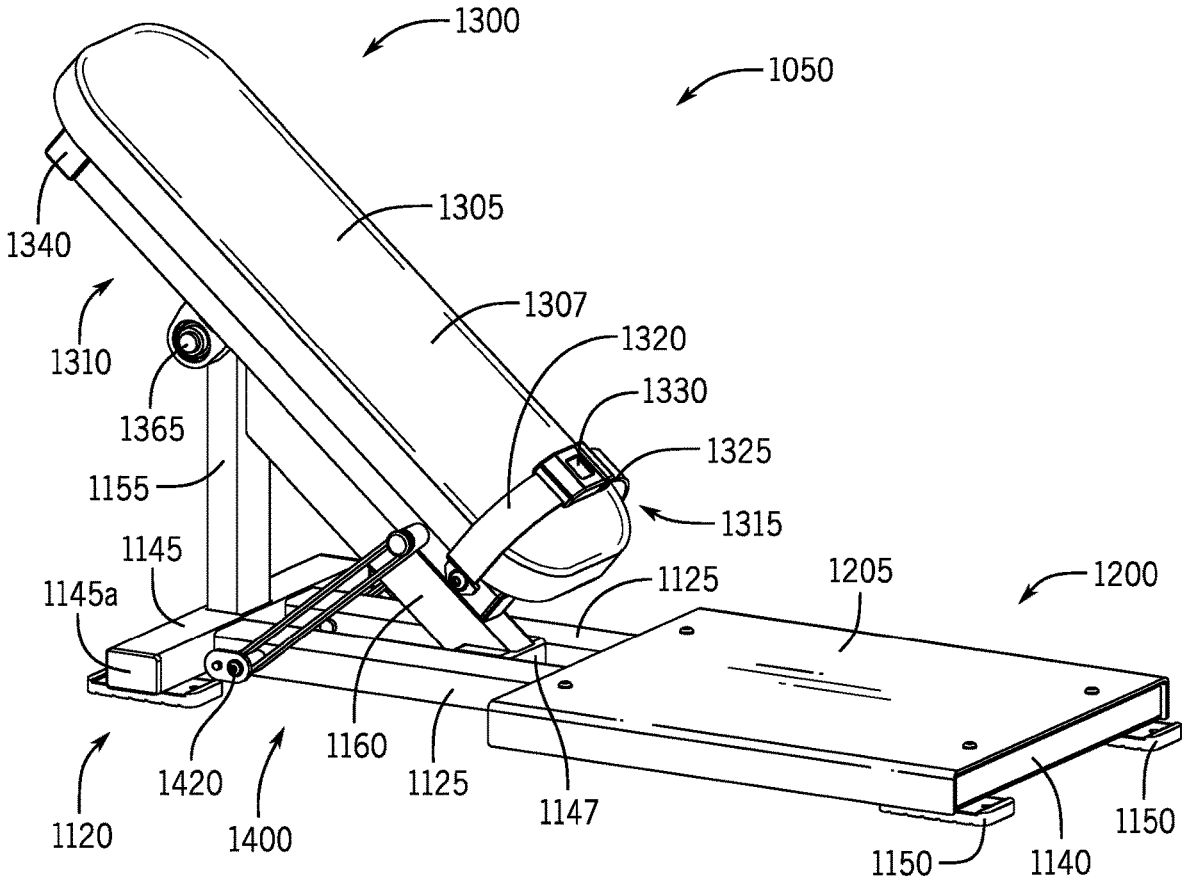
FIG. 12 is a perspective view of a second embodiment of an exercise apparatus for performing a gluteal bridge movement, showing the exercise apparatus in a first position where the apparatus is ready to use.

The bench assembly 1300 is pivotally connected to the support frame 1120 to allow for pivotal movement of the bench 1305 and the bench support frame assembly 1310 during the user's performance of the gluteal bridge exercise. Referring to FIGS. 12-13 and 15, the bench assembly 1300 includes at least one bearing assembly 1360 that receives an extent of a rod 1365 extending through an upper portion of the vertical member 1155. The bearing assembly 1360 includes an internal bearing set 1370 mounted within a housing 1375 that extends downward from the bench support frame assembly 1310. The bearing assembly 1360 is preferably a pillow block bearing with a curvilinear housing 1375. As shown in FIG. 15, there are two bearing assemblies 1360, each extending downward from an extent of the side frame member 1335. In this configuration, the rod 1365 extends from the vertical member 1155 and an end segment of the rod 1365 extends through the bearing set 1370. Also in this configuration, the vertical member 1155 is positioned between the bearing assemblies 1360. The rod 1365 defines a pivot point PP (see FIG. 13) where the bench assembly 1300 is pivotally connected to the support frame 1120 to allow for pivotal movement of the bench 1305 during performance of the gluteal bridge exercise. The pivot point PP is in an elevated vertical position relative to: (i) the support surface upon which the apparatus 1050 rests, (ii) the deck plate member 1205, and (iii) a resistance point RP (as detailed below and shown in FIG. 14). This does not mean that the pivot point PP is directly above these other components; instead, the pivot point PP is located at a higher vertical elevation compared to these components. Accordingly, the vertical elevation of pivot point PP is greater than the resistance point RP and the deck plate member 1205. In the embodiment of FIGS. 12-19, when the apparatus 1050 is in the first position or bottom position $P_B$, the engagement between the angled member 1160 and the intermediate cross member 1345, as provided by the bumper 1350, and between the side frame member 1335 and the vertical member 1155, as provided by the bearing assembly 1360, ensures that both the bench 1305 and the side frame member 1335 are substantially parallel to the angled member 1160. This positional arrangement improves the stability of the bench 1305 both when the user lays on the bench 1305 to prior to securing the belt assembly 1315 and beginning the first repetition of the gluteal bridge movement, and when the user is laying on the bench 1305 while performing gluteal bridge movements.

As shown in FIGS. 12-19, the resistance assembly 1400 includes a resistance band 1405 and a means for releasably securing 1410 the resistance band 1405 to both the frame assembly 1120 and bench assembly 1300. The resistance assembly 1400 provides a resistance force, in addition to the effects of gravity, that the user U must overcome in order to pivotally move the bench 1305 from a first position (see FIG. 18) to a second position (see FIG. 19) about the pivot point. In particular, the means for securing 1410 includes an upper securement means 1415 and a lower securement means 1420. These securement means 1415, 1420 can include a projection or combination of projections, a hook, a channel, a recess, or an aperture. As shown in FIGS. 12-19, the upper securement means 1415 includes projections 1425 that extend outwardly from both side frame members 1335, namely an outer surface of the member 1335. These projections 1425 are preferably positioned near the belt coupler 1337 and do not extend outwardly past the end wall 1145*a* of the rear member 1145. The center of the projection 1425 forms a resistance point RP, which is angularly displaced about the pivot point PP when the exercise apparatus 1050 moves from the ready for use position $P_U$ through the hip extended position $P_E$ and back to the bottom position $P_B$. The resistance point RP is in an elevated vertical position relative to: (i) the support surface upon which the apparatus 1050 rests and (ii) the deck plate member 1205. The resistance point RP is in a lower vertical position relative to the pivot point PP. This does not mean that the resistance point RP is aligned directly above or directly below these other components; instead, the resistance point RP is located at different vertical elevations compared to these components. Accordingly, the vertical elevation of resistance point RP is between the pivot point PP and the deck plate member 1205. Additionally, the projections 1425 may have a raised outer lip 1430 that helps ensure that the resistance assembly 1400 does not disengage projections 1425 during use of the exercise apparatus 1050.

Referring to FIGS. 12-19, the lower securement means 1420 includes a first projection 1435 that extends outwardly from the central members 1125. The lower securement means 1420 can also include a second projection 1440 that also extends from the central members 1125, and a securement plate 1445 positioned proximate the second projection 1440. In the embodiment of FIGS. 12-19, the first and second projections 1435, 1440 extend outwardly from the central members 1125 near the rear member 1145. The first and second projections 1435, 1440 do not extend past the end wall 1145*a* of the rear member 1145. The resistance band 1405 is operatively connected to the first projection 1435, while the second projection 1440 and the securement plate 1445 help ensure that band 1405 does not disengage the first projection 1435 during use of the exercise apparatus 1050. The user U may change the resistance band 1405 of the exercise apparatus 1050 shown in FIGS. 12-19 by first releasing the connecting plate 1445 from the first and second projections 1435, 1440. Next, the user U slides the bottom 1405*a* of the resistance band 1405 off of the lower securement means 1420. This in turn, enables the user to disconnect the top 1405*b* of the resistance band 1405 from the upper securement means 1415. The user then slides the alternative resistance band onto the upper securement means 1415 and then onto the lower securement means 1420. Finally, the user connects the connecting plate 1445 to both the first and second projections 1435, 1440.

As shown in FIGS. 16-17, when connected to the upper and lower securement means 1415, 1420, the resistance bands 1405 are positioned external to or beyond the central members 1125 and the bench side members 1335. This relative positioning provides a number of benefits, including the rapid exchange of different resistance bands 1405 that provide varying levels of resistance during the performance of the gluteal bridge movement. In other words, the resistance bands 1405 are not positioned completely beneath and within the periphery of the bench 1305. The top view in FIG. 16 and the bottom view in FIG. 17 show the first and second projections 1425, 1435 residing in a substantially vertical plane VP that is oriented perpendicular to the drawing sheet and substantially parallel to the central members 1125. Because the projections 1425, 1435 have a length that exceeds the width of the band 1405, the projections 1425, 1435 provide the vertical plane VP with a width or thickness that exceeds the width of the band 1405. During the performance of the gluteal bridge movement, the resistance bands 1405 elastically deform in a manner that causes each band 1405 to be displaced both vertically and within the vertical plane VP. In other words, the band 1405 is elastically deformed in a substantially parallel direction that is within the vertical plane VP. Overall, this arrangement of the resistance assembly 1400 and its components ensures smooth and consistent elastic deformation of the assembly 1400 during the bridge movement, which facilitates proper operation of the exercise apparatus 1050. It should be understood that the lower securement means 1420 may be connected to various other locations, which include the rear member 1145, rear vertical member 1155, or the angled member 1160. However, these alternate connection locations should be selected in a manner that does not impact or compromise the elastic deformation of the assembly 1400 during the bridge movement, or comprise the proper operation of the exercise apparatus 1050.

There are numerous critical dimensions, angles and ratios of the components of the apparatus 1050 to ensure that the user can perform gluteal bridge exercises in a highly productive, efficient and same manner. For example, the angle A formed between the vertical member 1155 and the angled member 1160 is 30 to 65 degrees, preferably 50 degrees. The angle B formed between the sloped member 1160 and the middle cross member 1147 is 25 to 60 degrees, preferably 40 degrees. Referring to FIG. 13, the pivot point PP is located at a distance of P1 from the bottom edge of the rear member 145, where P1 is at least 14 inches, preferably 16 inches. The lower securement member 1420 is located at a distance of C1, which is less than 6 inches from the pivot point PP, and preferably 4 inches from that point. Also, as shown in FIGS. 12-19, the exercise apparatus 1050 has a non-elevated foot rest which ensures that the user is able to perform the resisted gluteal bridge in a controlled, safe and effective manner. In contrast, a footrest that is elevated over the pivot point PP places unnecessary strain on the user's neck. Additionally, an elevated foot plate, coupled with the forces of gravity, creates a shear force between the bench and the user's body which can cause the user to inadvertently slide on the bench while attempting the bridge motion.

When the bench assembly 300 is in the first position or bottom position $P_B$ of FIGS. 12-17, the resistance point RP is located at a distance of R1 vertically above the bottom edge of the central members 1125, where R1 is at least 6 inches from that edge, preferably 8.5 inches. Also, when the bench assembly 1300 is in the first or bottom position $P_B$, the resistance point RP is located at a distance of R2, which is at least 10 inches from the pivot point PP, preferably 16 inches from that point PP. Further, when the user is properly positioned on and secured to the bench assembly 1300 with the belt assembly 1315, a second or ready for use position $P_U$, which is shown in FIG. 18. In the ready for use position $P_U$, the user's U knees and hips are in a flexed position and his/her hips are not extended, meaning the user's hips are bent to an angle between 60 and 110 degrees depending on the selected placement of user's feet, as shown in FIG. 18. When performing the gluteal bridge exercise, the user will attain a third or hip extended position $P_E$, which is shown in FIG. 19. When the user moves from the ready for use position $P_U$, to the hip extended position $P_E$, the resistance point RP is displaced in a substantially curvilinear motion as the bench assembly 300 pivots about the pivot point PP. In the hip extended position $P_E$, the resistance point RP is located at least 13.5 inches from the bottom edge of the central members 1125, and preferably 17.5 inches from that edge.

These dimensions, angles and ratios are essential to the functionality of the apparatus 1050 and its long-term operation for a number of reasons. First, these angles are essential to the design and layout of the exercise apparatus 1050 to ensure that the bench assembly 1300 is properly positioned relative to the supporting ground such that the person can access the bench assembly 1300 and then perform the resisted gluteal bridge in a controlled, safe and effective manner. Second, the bench 1305 is designed support the user's entire thorax, including the user's lumbar, thoracic, and cervical spines, in a neutral position throughout the entire range of motion of the exercise, which helps protect the user's spine and allows the motion of the exercise to be concentrated at the hip joints. Third, the operable configuration of the bench 1305 to the vertical member 1155 provides a pivot point PP generally aligned with an inferior aspect of the user's scapulae and the user's thoracic spine. When the user is properly positioned on the bench 1305, the pivot point PP is located between thoracic vertebras T1 through 12 of the human spine, preferably between vertebrae T3-T9, and most preferably between vertebrae T5-T7.

The exercise apparatus 1050 facilitates the performance of a resisted gluteal bridge by a user in a safe, controlled and efficient manner. FIG. 18 shows a user U in the second or ready for use position $P_U$, where the user U is lying on the bench 1305 prior and FIG. 19 shows the user U in the third or hip extended position $P_E$, which represents an upper state of the gluteal bridge movement. The exercise apparatus 1050 is configured to protect the spine of the user U by maintaining the lumbar, thoracic and cervical spine in a neutral position throughout the entire range of motion of the exercise, and also allows the bridging motion of the exercise to be concentrated at the user's hip joints. The apparatus 1050 purposely eliminates any accessory movement through the user's spine and improves overall effectiveness of the resisted gluteal bridge exercise.

FIG. 18 shows the user U in the second position, which illustrates both the ready for use position $P_U$ prior to the commencement of the exercise and the bottom position $P_B$ that is achieved after the user U performs one complete gluteal bridge movement. In the ready for use position $P_U$, the bumper 1350 (see FIGS. 13, 18 and 19) affixed to the angled support member 1160 engages the cross member 1345 (see FIGS. 13, 18 and 19) of the bench 1305. To properly use the exercise apparatus 1050, the user U sits near the end of the bench 1305, suitable positions his/her feet on the deck assembly 1200, and aligns the inferior portion of their scapulae at, or proximate the pivot point. Once the user U is positioned on the bench 1305, the user U secures his or her hips and lower abdomen to the bench 1305 via the belt assembly 1315 and places his/her feet flat on the deck assembly 1200. Once the belt members 1320, 1325 are connected via the buckle 1330, the user adjusts the length of the first and/or second members 1320, 1325 to ensure that the belt assembly 1315 properly secures the user to the bench 1305 and attain the ready for use position $P_U$.

After the user U is secured to the bench 1305, the user U utilizes their gluteal muscles and accessory muscles of the hip and thigh to drive and elevate his/her hips in a substantially upward direction, as reflected by the upwardly directed arrow in FIG. 19. This upwardly directed movement by the user U causes the user's knees to move from a position of relative flexion towards a position of less flexion. Additionally, this upwardly directed movement by the user U causes the bottom portion 1305*a* of the bench 1305 to move upward and away from the deck assembly 1200 while the bench 1305 pivots around the pivot point PP. Further, this upwardly directed movement by the user U causes the resistance band 1405 to elastically deform, namely stretch or elongate and then return to the un-deformed state. This stretching or elongation of the resistance band 1405 adds resistance to the user's U ability to move the bottom portion 1305*a* of the bench 1305 upward. Therefore, the higher the tension of the resistance band 1405 the more force the user U will have to use to cause the bottom portion 1305*a* of the bench 1305 to move upward.

While the user's feet remain flat on the deck assembly 1200, the user U continues driving upward until he/she reaches the third or hip extended position $P_E$. The hip extended position $P_E$ occurs for most users U when the angle between the bench 1305 and the rear vertical member 1155 is between 60 degrees and 100 degrees, and typically is 80 degrees. Once the hip extended position $P_E$ is reached, the user U may hold or maintain this position for a period of time. After the user U has reached the hip extended position $P_E$, the user U allows the bottom bench portion 1305*a* to move downward towards the deck assembly 1200 until the cross member 1345 (see FIGS. 13, 18 and 19) makes contact with the bumper 1350 (see FIGS. 13, 18 and 19) whereby the bench 1305 reaches the bottom position $P_B$. In this manner, the user U progresses from the ready for use position $P_U$ through the hip extended position $P_E$ and back to the bottom position $P_B$, where the progression through these three positions defines one complete repetition of the gluteal bridge exercise. After the user U completes the desired number of repetitions, the user U releases the buckle 1330, which causes the first and second members 1320, 1325 to disengage from one another. The user U is then able to stand-up and exit from the exercise apparatus 1050.

FIGS. 20-31 depict a third embodiment of the apparatus 2050 for performing a resisted gluteal bridge movement that is configured for a lighter use environment, such as in a use in a home gym. The exercise apparatus 2050 generally comprises: (i) a support assembly 2100 with a frame assembly 2120 and a deck assembly 2200; (ii) a bench assembly 2300; and, (iii) a resistance assembly 2400. The exercise apparatus 2050 is designed to be placed on a planar support surface or floor F within the gym, fitness center, training facility, or a home. As described in greater detail below, the user or person selects a level of resistance on the resistance assembly 2400, secures himself/herself to the bench assembly 2300 and then performs at least one repetition of the resisted gluteal bridge movement. Typically, the user performs multiple repetitions of the resisted gluteal bridge movement as part of his/her training regimen.

Referring to FIGS. 20-31 and as mentioned above, the support assembly 2100 includes the frame assembly 2120 and the deck assembly 2200. The frame assembly 2120 comprises: (i) two primary or central members 2125, (ii) a front member 2140, (iii) a slideable middle cross member 2147, and (iv) a rear member 2145. As seen in the bottom view of FIG. 25, the central members 2125 are substantially parallel to each other. Specifically, the central members 2125 extend between the front member 2140 and rear member 2145. The central members 2125 are spaced a short distance apart to define a cavity 2126 through which the cross member 2147 is displaced when the exercise apparatus 2050 is moved to a fifth position or a collapsed position $P_C$. The middle cross member 2147 extends between the central members 2125 and is capable of sliding within a channel or slot 2149 formed in the central member 2125. This channel 2149 has a first end 2149*a*, which is proximate to the front cross member 2140. Positioning the middle cross member 2140 proximate to the first end 2149*a* positions the exercise apparatus 2050 in fifth position or a collapsed position $P_C$. This fifth position or a collapsed position $P_C$ will be discussed in greater detail below and in connection with FIGS. 30 and 31. The channel 2149 also has a second end 2149*b*, which is forward from the resistance assembly 2400 and rearward from the deck assembly 2200. Placing the middle cross member 2147 proximate to the second end 2149*b* positions the exercise apparatus 2050 in either a: 1) first or ready to use position $P_U$, 2) second or hip extended position $P_E$, a third or a bottom position $P_B$, or a fourth or a flat bench position $P_F$. Based on this arrangement, the members 2140, 2147 and 2145 are substantially parallel to each other and are substantially perpendicular to the central members 2125.

In the embodiment of FIGS. 20-24, the frame assembly 2120 further includes a rear support members 2157 that extends upward from the central members 2125 to a pivot point PP. In particular, the rear support members 2157 are coupled to the central members 2125 by a bolt 2159 that is positioned proximate to the rear member 2145. Also, the rear support members 2157 are coupled to an angled support member 2160 by a bolt 2161. The bolts 2159, 2161 enable the rear support members 2157 to collapse when the middle cross member 2147 is positioned proximate to the first end 2149*a*. An angled support member 2160 extends between the rear support member 2157 and the middle cross member 2147. The angled support member is U-shaped, which allows this support member to receive an extent of a locking support member 2162. The frame assembly 2120 further includes at least one front wheel 2184 and preferably two wheels.

The deck assembly 2200 comprises a lower plate member 2207, preferably horizontally arranged relative to the floor F, that extends below an extent of the central members 2125 (see FIG. 25). The deck assembly 2200 is intended to be a low-profile structure to facilitate the user's U ingress and egress from the apparatus 2050. As such, the plate member 2205 is positioned on or near to the support surface or floor F upon which the apparatus 2050 is placed. The deck assembly 2200 may have a non-skid surface placed over the lower plate member 2207 to help ensure that a user's feet do not slide during use of the apparatus 2050. In an alternative embodiment, an adjustable foot rest assembly that is similar to the foot rest assembly discussed above in connection with the first embodiment may be connected to the deck assembly 2200 and configured to engage the feet of the person that is using the apparatus 2050. As shown in the embodiment of FIGS. 20-24, the plate member 2207 is positioned below a pivot point PP (see FIG. 21) and below the bottom edge of the bench assembly 2300.

Figure 26:
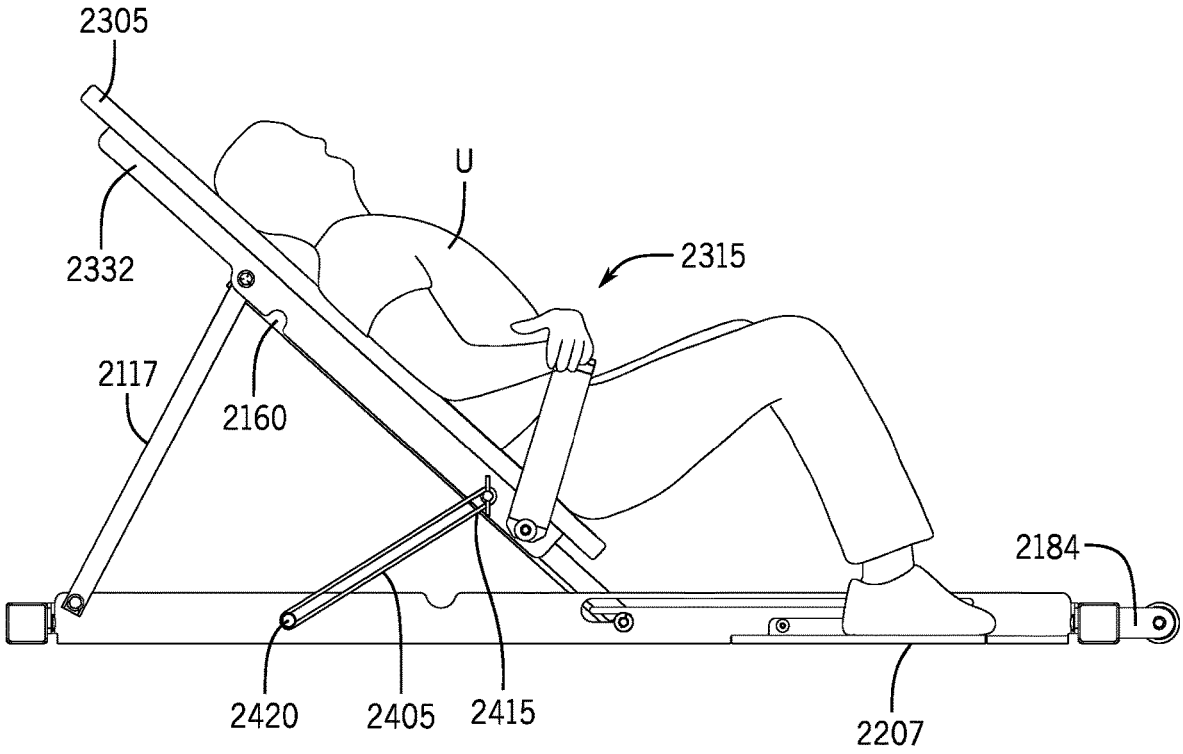
FIG. 26 is a side view of the exercise apparatus of FIG. 20, showing the exercise apparatus in a second position where a person is in a ready to use position and perform a gluteal bridge exercise.
Figure 27:
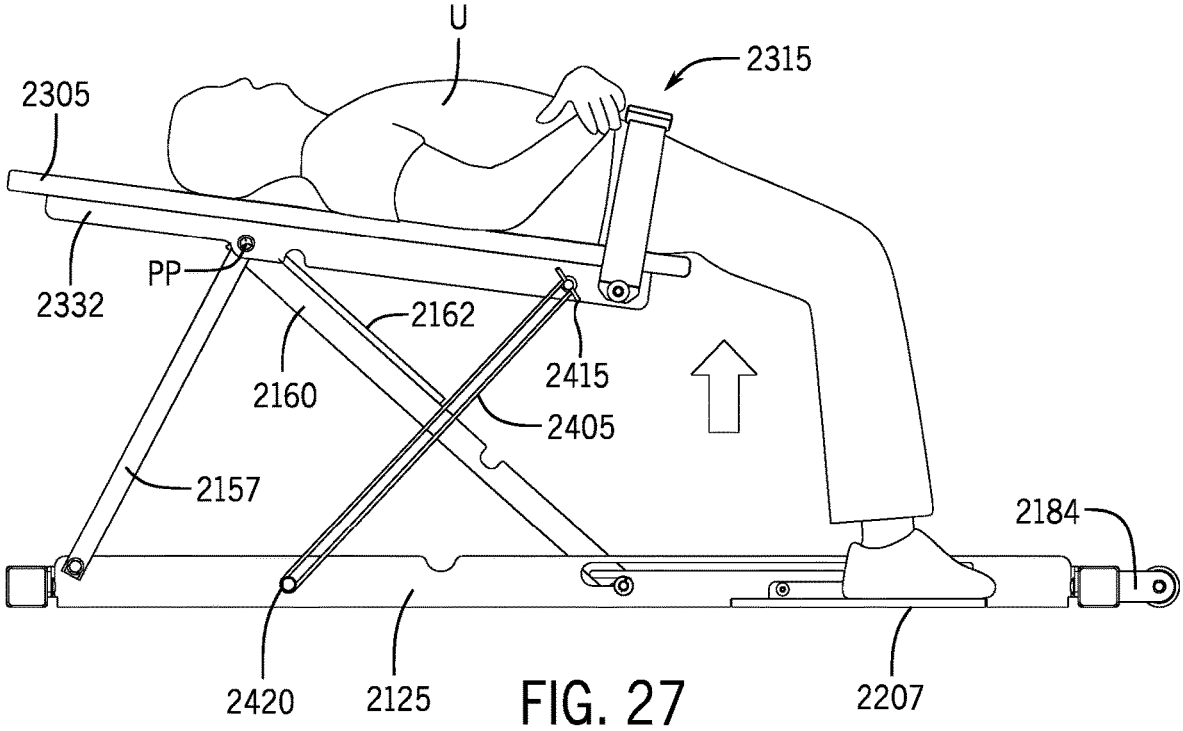
FIG. 27 is a side view of the exercise apparatus of FIG. 20, showing the exercise apparatus in a third position where the user's hips are in an extended position while performing a gluteal bridge exercise.

The bench assembly 2300 of the exercise apparatus 2050 comprises a bench 2305, a bench support frame assembly 2310 and a belt assembly 2315. The bench 2305 has a substantially rectangular configuration with internal pad member residing within an external housing 2307. The belt assembly 2315 includes a first member 2320, a second member 2325 and a buckle 2330 to operably connect the first and second members 2320, 2325. The belt assembly 2315 is operably connected by a coupler 2337 to the support frame assembly 2310 near a lower end 2305*a* of the bench 2305. As shown in FIGS. 26-27 and as explained below, the user secures the belt assembly 2315 across his/her lower abdomen before commencing the gluteal bride exercise. Unlike some conventional devices, the apparatus 2050 does not require additional structures above the bench assembly 2300 and the belt assembly 2315 to secure the user U to the bench 2305, such as mechanical linkages or an elongated pad that extends across the user's abdominal region. The bench 2305 is affixed to the support frame assembly 2310 which includes middle cross member 2147 and the rear support members 2157 (see FIGS. 23 and 25). Also, unlike some conventional devices, the apparatus 2050 includes a single bench 2305 that obviates the need for a secondary, typically lower, bench that assists a user with ingress and egress and/or further supports the user prior to and/or after the gluteal exercise movement.

Figure 20:
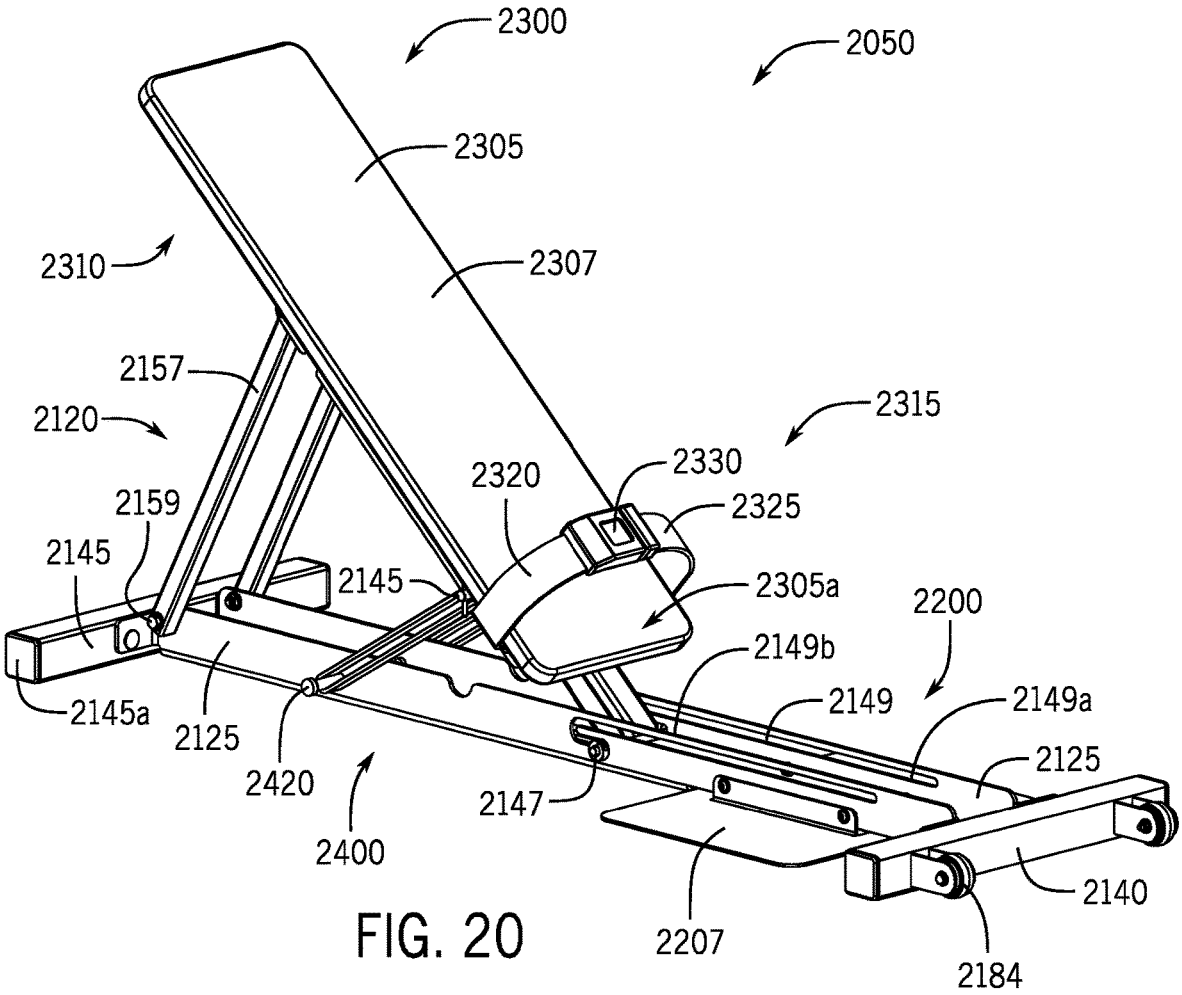
FIG. 20 is a perspective view of a third embodiment of an exercise apparatus for performing a gluteal bridge movement, showing the exercise apparatus in a first position where the apparatus is ready to use.
Figure 21:
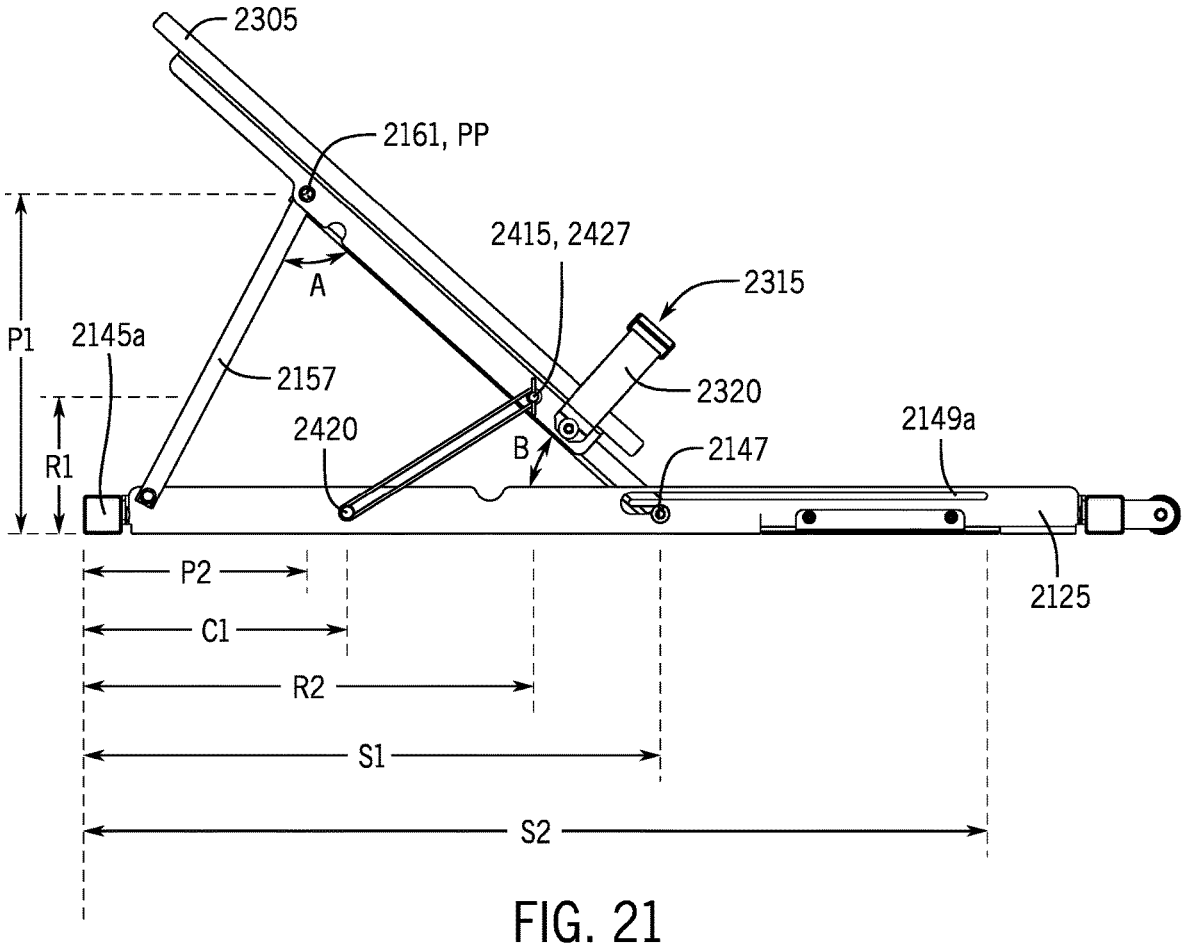
FIG. 21 is a side view of the exercise apparatus of FIG. 20.
Figure 22:
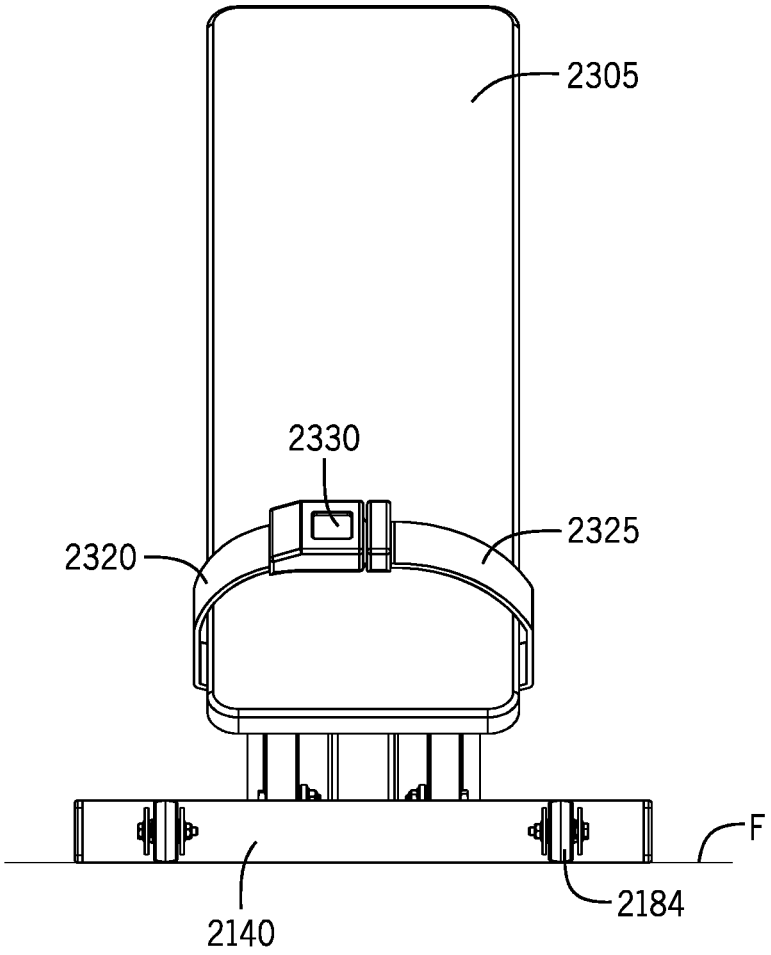
FIG. 22 is a front view of the exercise apparatus of FIG. 20.
Figure 23:
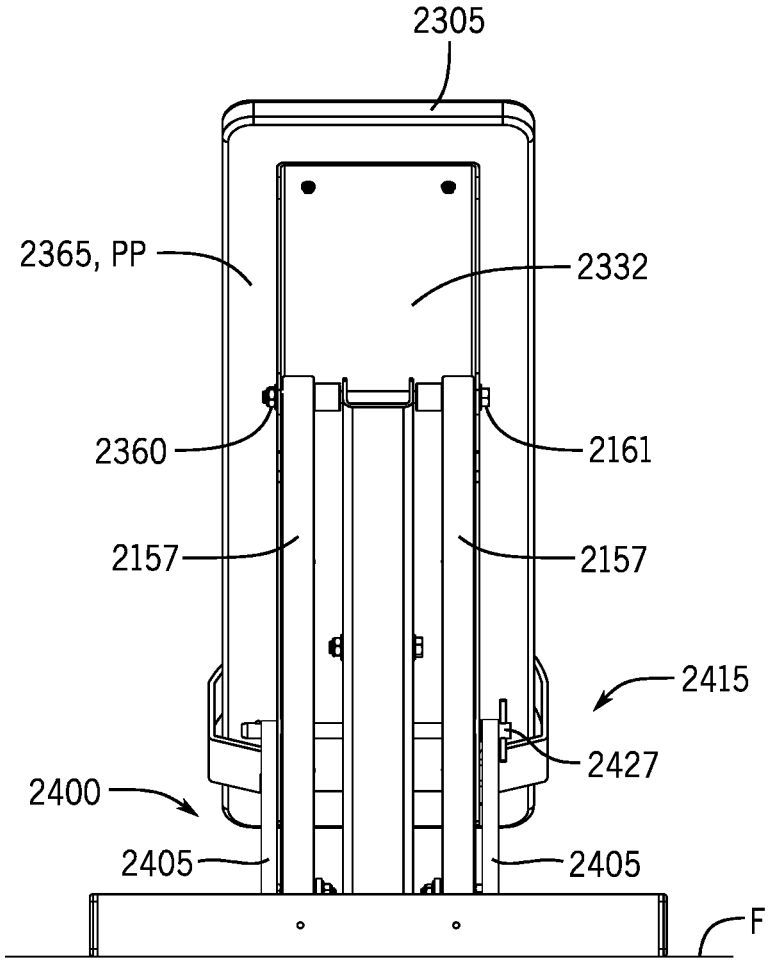
FIG. 23 is a rear view of the exercise apparatus of FIG. 20.

The bench assembly 2300 is pivotally connected to the support frame 2120 to allow for pivotal movement of the bench 2305 and the bench support frame assembly 2310 during the user's performance of the gluteal bridge exercise. Referring to FIGS. 20-21 and 23, the bench assembly 2300 includes at least one bushing assembly 2360 that receives an extent of a bolt 2161 that extends through the central frame member 2332, the rear support members 2157 and the angled support member 2160. The bolt 2161 defines a pivot point PP (see FIG. 21) where the bench assembly 2300 is pivotally connected to the support frame 2120 to allow for pivotal movement of the bench 2305 during performance of the gluteal bridge exercise. The pivot point PP is in an elevated vertical position relative to: (i) the support surface upon which the apparatus 2050 rests, (ii) the lower plate member 2207, and (iii) an resistance point RP (as detailed below and shown in FIG. 23). This does not mean that the pivot point PP is directly above these other components; instead, the pivot point PP is located at a higher vertical elevation compared to these components. Accordingly, the vertical elevation of pivot point PP is greater than the resistance point RP and the deck plate member 2205. In the embodiment of FIGS. 21-25, when the apparatus 2050 is in the first position or bottom position $P_B$, the engagement between the locking support member 2162 and the central frame member 2332, and between the central frame member 2332 and the rear support member 2157, as provided by the bushing assembly 2360, ensures that both the bench 2305 and the central frame member 2332 are substantially parallel to the angled member 2160. This positional arrangement improves the stability of the bench 2305 both when the user lays on the bench 2305 to prior to securing the belt assembly 2315 and beginning the first repetition of the gluteal bridge movement, and when the user is laying on the bench 2305 while performing gluteal bridge movements.

As shown in FIGS. 20-25, the resistance assembly 2400 includes a resistance band 1405 and a means for releasably securing 2410 the resistance band 2405 to both the frame assembly 2120 and bench assembly 2300. The resistance assembly 2400 provides a resistance force, in addition to the effects of gravity, that the user U must overcome in order to pivotally move the bench 2305 from a first position (see FIG. 26) to a second position (see FIG. 27) about the pivot point. In particular, the means for securing 1410 includes an upper securement means 2415 and a lower securement means 2420. These securement means 2415, 2420 can include a projection or combination of projections, a hook, a channel, a recess, a detent pin or a quick-release pin, or an aperture. As shown in FIGS. 20-25, the upper securement means 2415 includes releasable coupler mechanism that securely engages and then, upon actuation by the user U, quickly disengages a component of the bench assembly 2300. For example, this coupler mechanism is a quick-release pin 2427 that can removably inserted into a hole that is formed in central frame member 2332. This quick-release pin 2427 are preferably positioned near the belt coupler 2337 and do not extend outwardly past the end wall 2145*a* of the rear member 2145. The center of the quick-release pin 2427 forms a resistance point RP, which is angularly displaced about the pivot point PP when the exercise apparatus 2050 moves from the ready for use position $P_U$ through the hip extended position $P_E$ and back to the bottom position $P_B$. The resistance point RP is in an elevated vertical position relative to: (i) the support surface upon which the apparatus 2050 rests and (ii) the deck plate member 2205. The resistance point RP is in a lower vertical position relative to the pivot point PP. This does not mean that the resistance point RP is aligned directly above or directly below these other components; instead, the resistance point RP is located at different vertical elevations compared to these components. Accordingly, the vertical elevation of resistance point RP is between the pivot point PP and the deck plate member 2205. Additionally, the projections 2425 may have a raised outer lip 2430 that helps ensure that the resistance assembly 2400 does not disengage projections 2425 during use of the exercise apparatus 2050.

Referring to FIGS. 20-25, the lower securement means 2420 includes a projection 2425 that extends outwardly from the central members 2125 and positioned between the rear member 2145 and the middle cross member 2147. The projection 2425 does not extend past the end wall 2145*a* of the rear member 2145. The resistance band 2405 is operatively connected to the projection 2425. Additionally, the projection 2425 may have a raised outer lip 2430 that helps ensure that the resistance assembly 2400 does not disengage projection 2425 during use of the exercise apparatus 1050. The user U may change the resistance band 2405 of the exercise apparatus 2050 shown in FIGS. 20-25 by first exerting a force on the quick-release pin 2427 that is perpendicular to the central members 2125. Next, the user U slides the bottom 2405*a* of the resistance band 2405 off of the lower securement means 2420. The user then can slide an alternative resistance band onto the upper securement means 2415 and then onto the lower securement means 2420.

Figure 24:
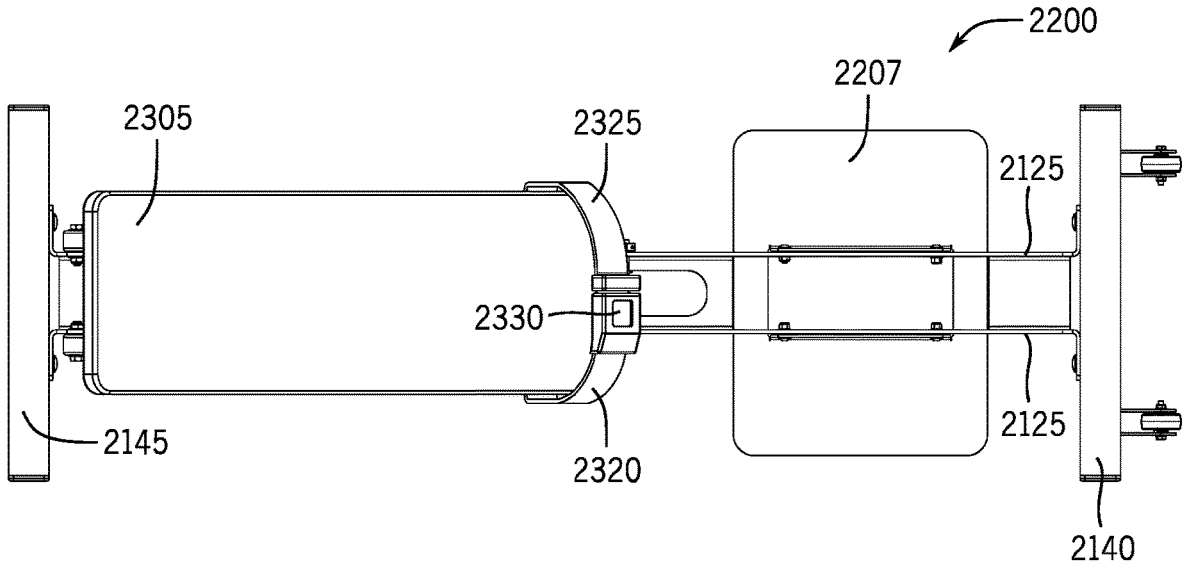
FIG. 24 is a top view of the exercise apparatus of FIG. 20.
Figure 25:
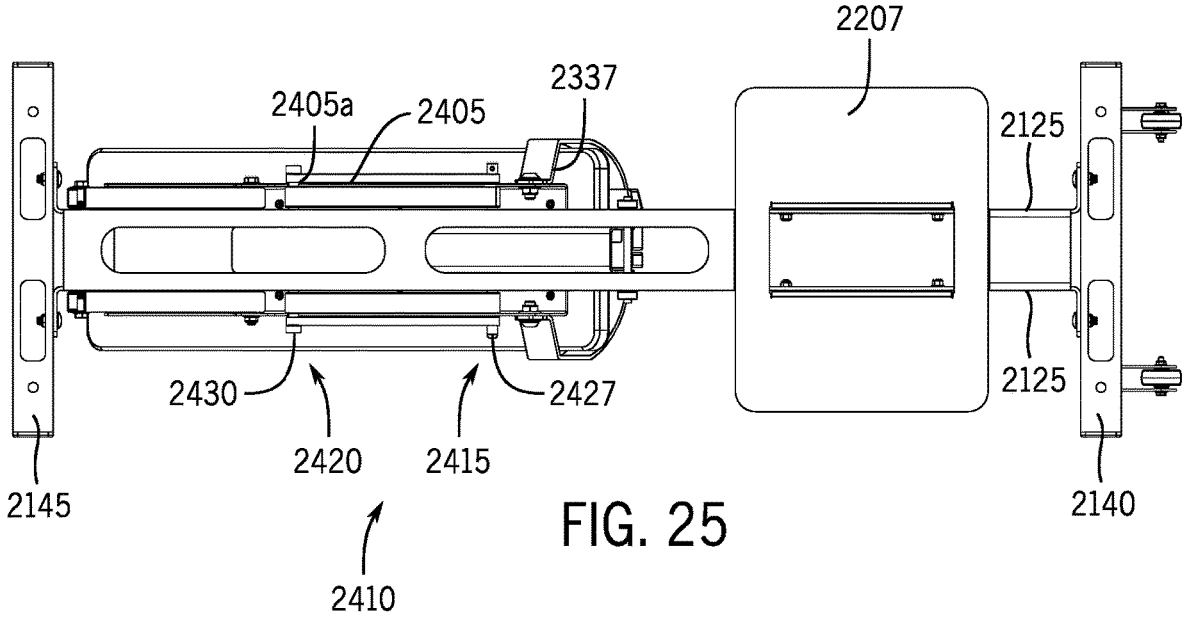
FIG. 25 is a bottom view of the exercise apparatus of FIG. 20.

As shown in FIGS. 24-25, when connected to the upper and lower securement means 2415, 2420, the resistance bands 2405 are positioned external to or beyond the central members 2125 and the angled support member 2160. This relative positioning provides a number of benefits, including the rapid exchange of different resistance bands 2405 that provide varying levels of resistance during the performance of the gluteal bridge movement. The top view in FIG. 24 and the bottom view in FIG. 25 show the first and second projections 2425, 2435 residing in a substantially vertical plane VP that is oriented perpendicular to the drawing sheet and substantially parallel to the central members 2125. Because the projections 2425, 2435 have a length that exceeds the width of the band 1405, the projections 2425, 2435 provide the vertical plane VP with a width or thickness that exceeds the width of the band 2405. During the performance of the gluteal bridge movement, the resistance bands 2405 elastically deform in a manner that causes each band 1405 to be displaced both vertically and within the vertical plane VP. In other words, the band 1405 is elastically deformed in a substantially parallel direction that is within the vertical plane VP. Overall, this arrangement of the resistance assembly 2400 and its components ensures smooth and consistent elastic deformation of the assembly 2400 during the bridge movement, which facilitates proper operation of the exercise apparatus 2050. Overall, this arrangement of the resistance assembly 2400 enables for smooth and consistent operation of the exercise apparatus 2050. It should be understood that the lower securement means 2420 may be connected to various other locations, which include the rear member 2145 or rear vertical member 2155. However, these alternate connection locations should be selected in a manner that does not impact or compromise the elastic deformation of the assembly 2400 during the bridge movement, or comprise the proper operation of the exercise apparatus 2050.

There are numerous critical dimensions, angles and ratios of the components of the apparatus 1050 to ensure that the user can perform gluteal bridge exercises in a highly productive, efficient and same manner. For example, the angle A formed between the rear support member 2157 and the angled member 2160 is 45 to 90 degrees, preferably 75 degrees. The angle B formed between the sloped member 2160 and the central members 2125 is 28 to 73 degrees, preferably 42 degrees. Referring to FIG. 21, the pivot point PP is located at a distance of P1 from the bottom edge of the rear member 2145, where P1 is at least 14 inches, preferably 18 inches. The pivot point PP is located at a distance of P2 from the rear edge of the rear member 2145, where P2 is at least 8 inches, preferably 11 inches. The lower securement member 2420 is located at a distance of C1, which is less than 16 inches from the rear edge of the rear member 2145, and preferably 14 inches from that point. The first end 2149*a* of the channel 2149 is located at a distance of S1 from the rear edge of the rear member 2145, where S1 is at least 25 inches, preferably 30 inches. The second end 2149*b* of the channel 2149 is located at a distance of S2 from the rear edge of the rear member 2145, where S2 is at least 37 inches, preferably 47 inches. Also, as shown in FIGS. 20-25, the exercise apparatus 1050 has a non-elevated foot rest which ensures that the user is able to perform the resisted gluteal bridge in a controlled, safe and effective manner. In contrast, a footrest that is elevated over the pivot point PP places unnecessary strain on the user's neck. Additionally, an elevated foot plate, coupled with the forces of gravity, creates a shear force between the bench and the user's body which can cause the user to inadvertently slide on the bench while attempting the bridge motion.

When the bench assembly 2300 is in the first position or bottom position $P_B$ of FIGS. 20-25, the resistance point RP is located at a distance of R1 vertically above the bottom edge of the central members 2125, where R1 is at least 4 inches from that edge, preferably 7 inches. Also, when the bench assembly 300 is in the first or bottom position $P_B$, the resistance point RP is located at a distance of R2, which is at least 15 inches from the rear edge of the rear member 2145, preferably 23 inches from that rear edge. Further, when the user is properly positioned on and secured to the bench assembly 2300 with the belt assembly 2315, a second or ready for use position $P_U$, which is shown in FIG. 26. In the ready for use position $P_U$, the user's U knees and hips are in a flexed position and his/her hips are not extended, meaning the user's hips are bent to an angle between 60 and 110 degrees depending on the selected placement of user's feet, as shown in FIG. 26. When performing the gluteal bridge exercise, the user will attain a third or hip extended position $P_E$, which is shown in FIG. 27. When the user moves from the ready for use position $P_U$, to the hip extended position $P_E$, the resistance point RP is displaced in a substantially curvilinear motion as the bench assembly 2300 pivots about the pivot point PP. In the hip extended position $P_E$, the resistance point RP is located at least 13 inches from the bottom edge of the central members 2125, and preferably 16 inches from that edge.

These dimensions, angles and ratios are essential to the functionality of the apparatus 2050 and its long-term operation for a number of reasons. First, these angles are essential to the design and layout of the exercise apparatus 2050 to ensure that the bench assembly 1300 is properly positioned relative to the supporting ground such that the person can access the bench assembly 2300 and then perform the resisted gluteal bridge in a controlled, safe and effective manner. Second, the bench 2305 is designed support the user's entire thorax, including the lumbar, thoracic and cervical spines, in a neutral position throughout the entire range of motion of the exercise, which helps protect the user's spine and allows the motion of the exercise to be concentrated at the hip joints. Third, the operable configuration of the bench 2305 to the rear support member 2157 provides a pivot point PP generally aligned with an inferior aspect of the user's scapulae and the user's thoracic spine. When the user is properly positioned on the bench 2305, the pivot point PP is located between thoracic vertebras T1 through 12 of the human spine, preferably between vertebrae T3-T9, and most preferably between vertebrae T5-T7.

The exercise apparatus 2050 facilitates the performance of a resisted gluteal bridge by a user in a safe, controlled and efficient manner. FIG. 26 shows a user U in the second or ready for use position $P_U$, where the user U is lying on the bench 2305 prior and FIG. 27 shows the user U in the third or hip extended position $P_E$, which represents an upper state of the gluteal bridge movement. The exercise apparatus 2050 is configured to protect the spine of the user U by maintaining the lumbar spine in a neutral position throughout the entire range of motion of the exercise, and also allows the bridging motion of the exercise to be concentrated at the user's hip joints. The apparatus 2050 purposely eliminates any accessory movement through the user's spine and improves overall effectiveness of the resisted gluteal bridge exercise.

FIG. 26 shows the user U in the second position, which illustrates both the ready for use position $P_U$ prior to the commencement of the exercise and the bottom position $P_B$ that is achieved after the user U performs one complete gluteal bridge movement. In the ready for use position $P_U$, the central member 2332 engages the locking support member 2162 of the bench 2305. To properly use the exercise apparatus 2050, the user U sits near the end of the bench 2305, suitable positions his/her feet on the deck assembly 2200, and aligns the inferior portion of their scapulae at, or proximate the pivot point, PP. Once the user U is positioned on the bench 2305, the user U secures his or her hips and lower abdomen to the bench 2305 via the belt assembly 2315 and places his/her feet flat on the deck assembly 2200. Once the belt members 2320, 2325 are connected via the buckle 2330, the user adjusts the length of the first and/or second members 2320, 2325 to ensure that the belt assembly 2315 properly secures the user to the bench 2305 and attain the ready for use position $P_U$.

After the user U is secured to the bench 2305, the user U utilizes their gluteal muscles and accessory muscles of the hip and thigh to drive and elevate his/her hips in a substantially upward direction, which as reflected by the upwardly directed arrow in FIG. 27. This upwardly directed movement by the user U causes the users knees move from a position of relative flexion towards a position of less knee flexion. Additionally, this upwardly directed movement by the user U causes the bottom portion **2305*a* of the bench 2305 to move upward and away from the deck assembly 2200 while the bench 2305 pivots around the pivot point PP. Further, this upwardly directed movement by the user U causes the resistance band 2405 to stretch or elongate. This stretching or elongation of the resistance band 2405 adds resistance to the user's U ability to move the bottom portion 2305*a* of the bench 2305 upward. Therefore, the higher the tension of the resistance band 2405 the more force the user U will have to use to cause the bottom portion 2305*a* of the bench 2305** to move upward.

While the user's feet remain flat on the deck assembly 2200, the user U continues driving upward until he/she reaches the third or hip extended position $P_E$. The hip extended position $P_E$ occurs for most users U when the angle between the bench 2305 and the rear support member 2157 is between 60 degrees and 100 degrees, and typically is 80 degrees. Once the hip extended position $P_E$ is reached, the user U may hold or maintain this position for a period of time. After the user U has reached the hip extended position $P_E$, the user U allows the bottom bench portion **2305*a* to move downward towards the deck assembly 2200 until the central member 2332 engages the locking support member 2162 of the bench 2305 whereby the bench 1305 reaches the bottom position $P_B$. In this manner, the user U progresses from the ready for use position $P_U$ through the hip extended position $P_E$ and back to the bottom position $P_B$, where the progression through these three positions defines one complete repetition of the gluteal bridge exercise. After the user U completes the desired number of repetitions, the user U releases the buckle 2330, which causes the first and second members 2320, 2325 to disengage from one another. The user U is then able to stand-up and exit from the exercise apparatus 2050**.

Figure 28:
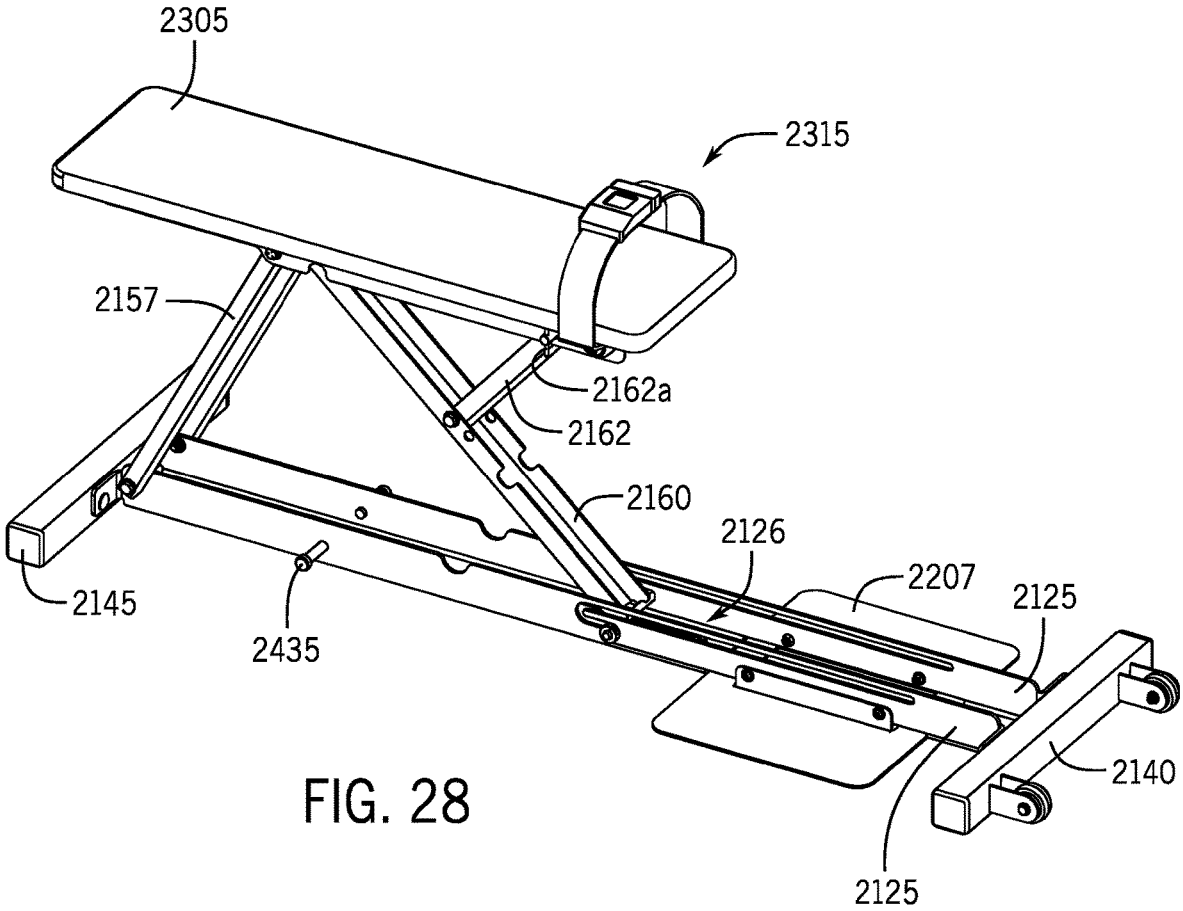
FIG. 28 is a perspective view of the exercise apparatus of FIG. 20, showing the exercise apparatus in a fourth position where the bench is locked in a position that is substantially parallel with an extent of the support frame.
Figure 29:
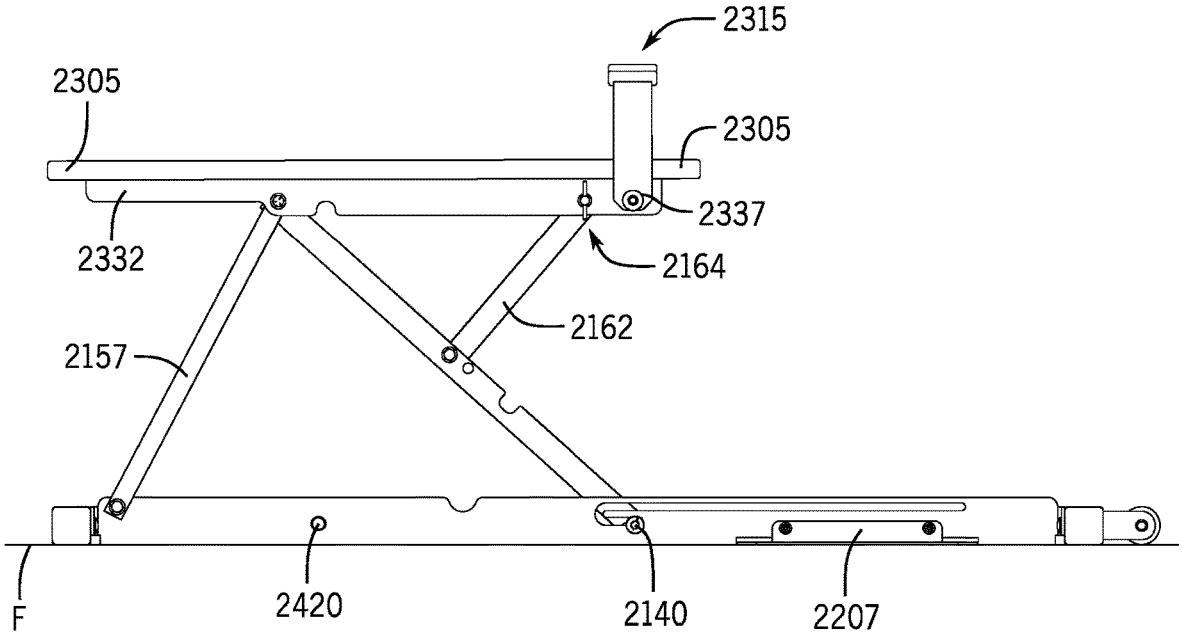
FIG. 29 is a side view of the exercise apparatus of FIG. 20, showing the exercise apparatus in a fourth position where the bench is locked in a position that is substantially parallel with an extent of the support frame.
Figure 30:
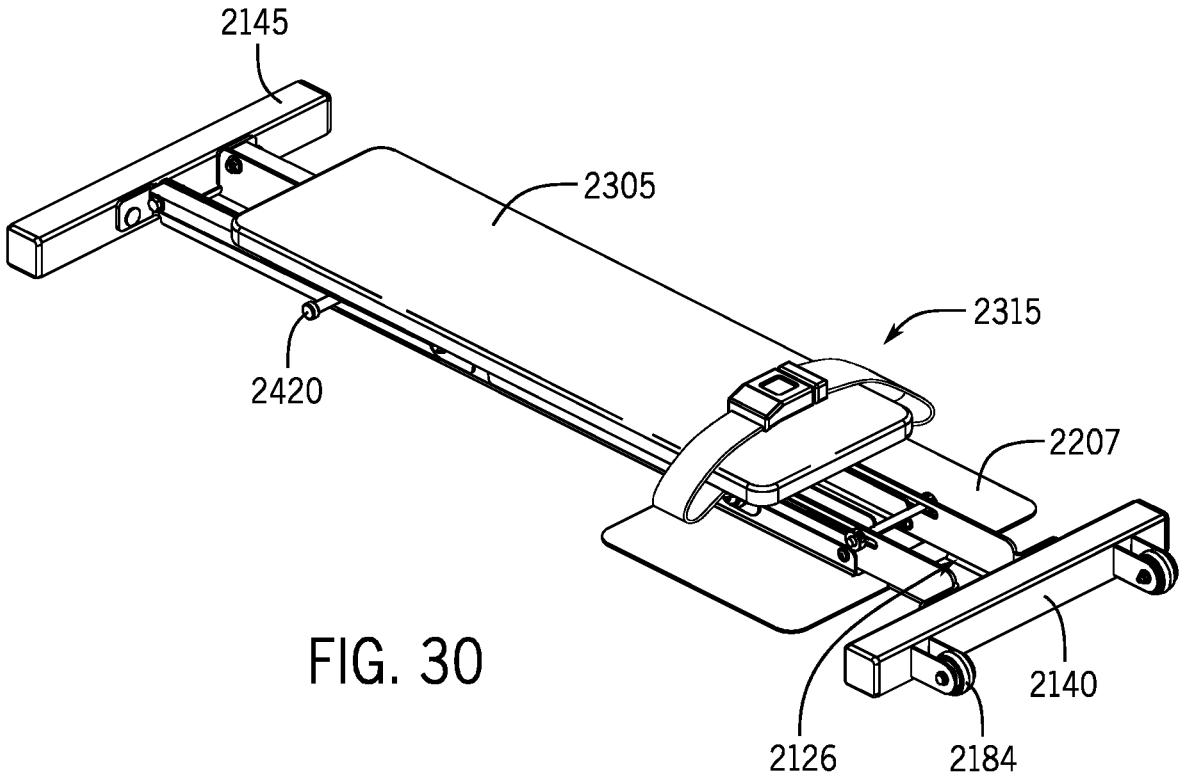
FIG. 30 is a perspective view of the exercise apparatus of FIG. 20, showing the exercise apparatus in a fifth position where the exercise apparatus is collapsed.
Figure 31:
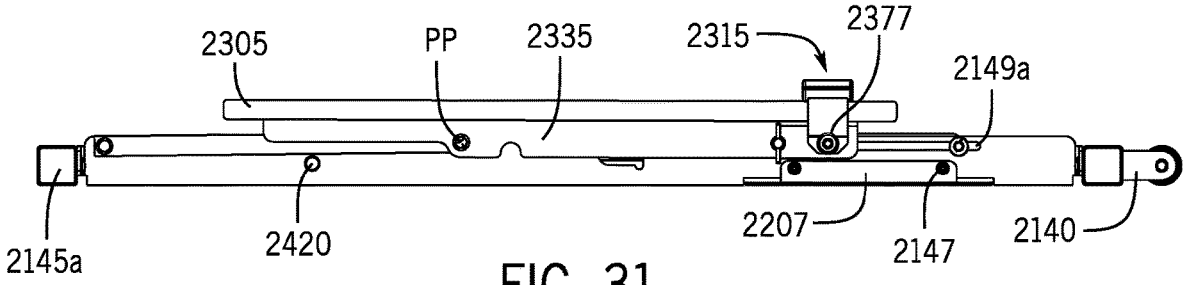
FIG. 31 is a side view of the exercise apparatus of FIG. 20, showing the exercise apparatus in a fourth position where the exercise apparatus is collapsed.

In addition to the first three positions (i.e., ready to use position $P_U$, hip extended position $P_E$ and bottom position $P_B$), the exercise apparatus 2050 may be placed in a fourth position (i.e., flat bench position $P_F$) and a fifth position (i.e., collapsed position $P_C$). Specifically, the fourth or flat bench position $P_E$ is shown in FIGS. 28-29, while the fifth or collapsed position $P_C$ is shown in FIGS. 30-31.

To place the exercise apparatus 2050 in the fourth or flat bench position $P_E$ (see FIGS. 28-29) from the first position or ready to use position $P_U$ (see FIGS. 20-25), the user remove the quick-release pin 2427 from the exercise apparatus 2050 by exerting a force on the quick-release pin 2427 that is perpendicular to the central members 2125. Once the quick-release pin 2427 has been removed from the exercise apparatus 2050, the user lifts the bottom portion 2305*a* of the bench 2305 up until the bench is parallel or slightly past parallel with the central members 2125. The user then removes the locking support member 2162 from the storage position within the angled support member 2160 and aligns the holes 2164 in the end 2162*a* of the locking support member 2162 with the holes 2334 in the central frame member 2332. The user then inserts the quick-release pin 2427 through the aligned holes 2164, 2334, which in turn locks the bench 2305 in a state that is substantially parallel with the central members 2125. Once the bench 2305 is locked in this fourth or flat bench position $P_E$ position, the user can utilize the exercise apparatus 2050 in a manner that is similar to how a user would typically use a flat bench. For example, the user may perform dumbbell flyes or presses while lying on the bench 2305 since it is in a horizontal position.

To place the exercise apparatus 2050 in the fifth or collapsed position $P_C$ (see FIGS. 30-31) from the first position or ready to use position $P_U$ (see FIGS. 20-25), the user remove the quick-release pin 2427 from the exercise apparatus 2050 by exerting a force on the quick-release pin 2427 that is perpendicular to the central members 2125. Once the quick-release pin 2427 has been removed from the exercise apparatus 2050, the user removes the resistance bands 2405 from the exercise apparatus 2050. The user then re-inserts the quick-release pin 2427 into the same location on the exercise apparatus 2050. Once the middle cross member 2147 has reached the rearwardmost position of the channel 2149, the user applies a force on the bench 2305 that is substantially perpendicular to the central members 2125. This causes the middle cross member 2147 to move in the channel 2419 from the second end 2149*b* to the first end 2149*a*. The exercise apparatus 2050 in the fifth or collapsed position $P_C$ once the middle cross member 2147 is positioned proximate to the first end 2149*a*. In the collapsed position $P_C$ the bench assembly 2300 and the frame assembly 2120, including the frame assembly 2120 and the deck assembly 2200, are positioned adjacent to each other or "stacked together," which enables the user to easily store the exercise apparatus 2050 in a small space, such as under the user's bed, when not being used.

The above disclosure may represent an improvement in the art because the exercise apparatus 50, 1050, 2050 allows a person or user to perform a gluteal bridge, typically with resistance, to improve the strength of a person's human posterior hip and gluteal muscles. The exercise apparatus 50, 1050, 2050 facilitates the performance of a resisted gluteal bridge in a safe, controlled and efficient manner. In particular, the exercise apparatus protects the person's spine by maintaining the lumbar spine in a neutral position throughout the entire range of motion of the exercise, and also allows the motion of the exercise to be concentrated at the person's hip joints. Additionally, the exercise apparatus 50, 1050, 2050 protects the user's pelvic bones from pressure that occurs when a heavy weight plate, barbell or dumbbells are placed across the upper portion of the user's hips, as done with conventional attempts to perform resisted gluteal bridges. Also, in contrast to other methods discussed above, the exercise apparatus 50, 1050, 2050 allows the user to perform the resisted gluteal bridge with only one leg or hold the bridge in the hip extended position while "alternately lifting one leg then the other in marching steps."

While some implementations have been illustrated and described, numerous modifications come to mind without significantly departing from the spirit of the disclosure; and the scope of protection is only limited by the scope of the accompanying claims.

Headings and subheadings, if any, are used for convenience only and are not limiting. The word exemplary is used to mean serving as an example or illustration. To the extent that the term include, have, or the like is used, such term is intended to be inclusive in a manner similar to the term comprise as comprise is interpreted when employed as a transitional word in a claim. Relational terms such as first and second and the like may be used to distinguish one entity or action from another without necessarily requiring or implying any actual such relationship or order between such entities or actions.

Phrases such as an aspect, the aspect, another aspect, some aspects, one or more aspects, an implementation, the implementation, another implementation, some implementations, one or more implementations, an embodiment, the embodiment, another embodiment, some embodiments, one or more embodiments, a configuration, the configuration, another configuration, some configurations, one or more configurations, the subject technology, the disclosure, the present disclosure, other variations thereof and alike are for convenience and do not imply that a disclosure relating to such phrase(s) is essential to the subject technology or that such disclosure applies to all configurations of the subject technology. A disclosure relating to such phrase(s) may apply to all configurations, or one or more configurations. A disclosure relating to such phrase(s) may provide one or more examples. A phrase such as an aspect or some aspects may refer to one or more aspects and vice versa, and this applies similarly to other foregoing phrases.

Numerous modifications to the present disclosure will be apparent to those skilled in the art in view of the foregoing description. Preferred embodiments of this disclosure are described herein, including the best mode known to the inventors for carrying out the disclosure. It should be understood that the illustrated embodiments are exemplary only, and should not be taken as limiting the scope of the disclosure.

What is claimed is:

1. An exercise apparatus configured to allow a user to perform a gluteal bridge movement, the exercise apparatus comprising:

a lower frame assembly having a central member and a support member extending upward from said central member;

a bench assembly pivotally connected to an upper extent of the upwardly extending support member to provide an elevated pivot point about which the bench assembly pivots when the user performs the gluteal bridge movement;

a foot rest located along the central member of the lower frame assembly, wherein the foot rest and the bench assembly are arranged such that the foot rest is in a lower vertical position relative to the elevated pivot point; and, a resistance assembly providing a resistance force that the user overcomes in order to move the bench assembly between a ready to use position and an extended position about said elevated pivot point, wherein the resistance assembly is operably connected to a lower extent of the bench assembly at a resistance coupling location, wherein the resistance coupling location underlies the user's lumbar spine when the user lies on the bench assembly and moves the bench assembly between the ready to use position and the extended position.

2. The exercise apparatus of claim 1, wherein the foot rest is a foot rest assembly with a foot engaging surface and a releasable adjustment mechanism that allows for selective positioning of the foot rest in relation to both the bench assembly and a frontal extent of central member of the frame assembly.

3. The exercise apparatus of claim 2, wherein the foot engaging surface is angled relative to the central member of the frame assembly.

4. The exercise apparatus of claim 1, wherein the foot rest includes a deck assembly that overlies an extent of the central member of the frame assembly.

5. The exercise apparatus of claim 1, wherein the resistance assembly includes a weight stack and an elongated cable, wherein said elongated cable is routed along an extent of the frame assembly and between the weight stack and the lower extent of the bench assembly.

6. The exercise apparatus of claim 1, wherein the bench underlies and supports the user's lumbar, thoracic, and cervical spine when the user moves the bench assembly between the ready to use position and the extended position.

7. The exercise apparatus of claim 1, wherein a lowermost edge of the lower extent of the bench is in a lower vertical position relative to the foot rest when the bench assembly is in the ready to use position.

8. The exercise apparatus of claim 1, wherein the frame assembly further includes an angled member that extends upward from the central member, and wherein a bumper is coupled to the angled member and configured to engage a portion of the bench assembly when the bench assembly is in the ready to use position.

9. The exercise apparatus of claim 1, further comprising a belt assembly coupled to an extent of the bench assembly at a belt coupling location, and wherein said belt coupling location is positioned between the resistance coupling location and the lowermost edge of the lower extent of the bench assembly.

10. The exercise apparatus of claim 1, wherein the bench assembly comprises a first bench that the user lies upon to move the bench assembly between the ready to use position and the extended position, and the exercise apparatus does not include a second bench located below the first bench that is configured to support the user prior to or after the user moves the bench assembly between the ready to use position and the extended position.

11. An exercise apparatus configured to allow a user to perform a gluteal bridge movement, the exercise apparatus comprising:

a support assembly having a central member and a support member extending upward from said central member;

a bench assembly pivotally connected to an upper extent of the upwardly extending support member to provide an elevated pivot point about which the bench assembly pivots when the user performs the gluteal bridge movement;

a foot rest coupled to the support assembly, and wherein the foot rest and the bench assembly are arranged such that the foot rest is in a lower vertical position relative to the elevated pivot point;

a resistance assembly connected at a lower extent of the bench assembly, said resistance assembly providing a resistance force that the user overcomes in order to move the bench assembly between a ready to use position and an extended position about said pivot point; and wherein when the bench assembly is in the ready to use position, an upper edge of the foot rest is in an elevated vertical position relative to a lowermost edge of the lower extent of the bench assembly.

12. The exercise apparatus of claim 11, wherein the foot rest includes a foot rest assembly having a releasable adjustment mechanism that allows for selective positioning of the foot rest in relation to both the bench assembly and a frontal extent of central member of the support assembly.

13. The exercise apparatus of claim 11, wherein the foot rest includes a deck assembly that overlies an extent of the central member of the frame assembly.

14. The exercise apparatus of claim 11, wherein the resistance assembly includes (i) a selectable weight stack located in front of the foot rest, and (ii) an elongated cable routed along an extent of the support assembly and between said weight stack and a lower extent of the bench assembly.

15. The exercise apparatus of claim 11, wherein the bench is configured to underlie the user's lumbar, thoracic, and cervical spine when the user moves the bench assembly between the ready to use position and the extended position.

16. The exercise apparatus of claim 11, wherein the connection between the resistance assembly and the bench assembly underlies the user's lumbar spine when the user moves the bench assembly between the ready to use position and the extended position.

17. The exercise apparatus of claim 11, wherein the support assembly further includes an angled member that extends upward from the central member, and wherein a bumper is coupled to the angled member and configured to engage a portion of the bench assembly when the bench assembly is in the ready to use position.

18. The exercise apparatus of claim 11, wherein the exercise apparatus: (i) includes only a first bench that the user lies upon to move the bench assembly between the ready to use position and the extended position, and (ii) does not include a second bench configured to assist the user with ingress or egress from the exercise apparatus.

19. An exercise apparatus configured to allow a user to perform a gluteal bridge movement, the exercise apparatus comprising:

a frame assembly having a support member extending upward from a central member of the frame assembly;

a bench assembly that is: (i) configured to underlie the user's lumbar, thoracic, and cervical spine, and (ii) pivotally connected to an upper extent of the upwardly extending support member to provide a pivot point about which the bench assembly pivots when the user performs the gluteal bridge movement;

a foot rest assembly, wherein the foot rest assembly and the bench assembly are arranged such that the foot rest assembly is in a lower vertical position relative to the pivot point; and, a resistance assembly including (i) a selectable weight stack located in front of the foot rest assembly, and (ii) an elongated cable routed along an extent of the frame assembly and between said weight stack and a lower extent of the bench assembly, wherein the resistance assembly provides a resistance force that the user overcomes in order to move the bench assembly between a ready to use position and an extended position about said pivot point.

20. The exercise apparatus of claim 19, wherein a connection between the elongated cable and the lower extent of the bench assembly defines an anchor point, and wherein the anchor point moves in a curvilinear path when the user moves the bench assembly from the ready to use position to the extended position.

21. The exercise apparatus of claim 19, wherein the frame assembly further includes an angled member that extends upward from the central member, and wherein a bumper is coupled to the angled member and configured to engage a portion of the bench assembly when the bench assembly is in the ready to use position.

22. The exercise apparatus of claim 19, wherein in the ready to use position, a lowermost end of the bench assembly is positioned above an extent of the frame assembly to define a gap there between.

23. The exercise apparatus of claim 19, wherein the foot rest assembly includes a releasable adjustment mechanism that allows for selective positioning of the foot rest in relation to both the bench assembly and a frontal extent of central member of the support assembly.

24. The exercise apparatus of claim 19, wherein when the bench assembly is in the ready to use position, an extent of the foot rest assembly is in an elevated vertical position relative to a lowermost extent of the bench assembly.

25. The exercise apparatus of claim 19, wherein when the bench assembly is in the ready to use position, the entire foot rest assembly is positioned in a lower vertical position relative to an uppermost extent of the resistance assembly.

* * * * *